US011780639B2

(12) United States Patent
Rodriguez

(10) Patent No.: US 11,780,639 B2
(45) Date of Patent: Oct. 10, 2023

(54) OPTIMIZED SYSTEM, BOX AND BAG FOR PACKING, SHIPPING, STORING AND DISPLAYING PRODUCE

(71) Applicant: Chiquita Brands LLC, Fort Lauderdale, FL (US)

(72) Inventor: Francisco Rodriguez, Santa Ana (CR)

(73) Assignee: Chiquita Brands LLC, Fort Lauderdale, FL (US)

( * ) Notice: Subject to any disclaimer, the term of this patent is extended or adjusted under 35 U.S.C. 154(b) by 0 days.

(21) Appl. No.: 17/872,458

(22) Filed: Jul. 25, 2022

(65) Prior Publication Data

US 2023/0002107 A1 Jan. 5, 2023

Related U.S. Application Data

(63) Continuation of application No. 16/264,780, filed on Feb. 1, 2019, now abandoned.
(Continued)

(51) Int. Cl.
*B65D 5/42* (2006.01)
*B65D 5/32* (2006.01)
(Continued)

(52) U.S. Cl.
CPC ..... *B65D 5/4295* (2013.01); *B65D 5/001* (2013.01); *B65D 5/002* (2013.01); *B65D 5/0227* (2013.01); *B65D 5/20* (2013.01); *B65D 5/328* (2013.01); *B65D 5/4266* (2013.01); *B65D 5/4608* (2013.01); *B65D 5/60* (2013.01); *B65D 5/68* (2013.01); *B65D 33/01* (2013.01); *B65D 33/165* (2013.01); *B65D 33/1616* (2013.01); *B65D 33/28* (2013.01); *B65D 77/062* (2013.01); *B65D 85/34* (2013.01); *B65D 85/345* (2013.01)

(58) Field of Classification Search
CPC .... B65D 85/34; B65D 85/345; B65D 5/4295; B65D 5/20; B65D 5/4608; B65D 77/062; B65D 33/16
USPC ..... 206/423
See application file for complete search history.

(56) References Cited

U.S. PATENT DOCUMENTS 4,946,093 A * 8/1990 Moorman ..... B65D 5/4295 229/125.27
5,690,275 A * 11/1997 Bose ..... B65D 5/4295 220/676

(Continued)

FOREIGN PATENT DOCUMENTS

WO WO9711885 * 4/1997 ..... B65D 77/06
WO WO2011081636 * 7/2011 ..... B65D 5/00

*Primary Examiner* — Steven A. Reynolds
(74) *Attorney, Agent, or Firm* — FROST BROWN TODD LLP

(57) ABSTRACT

Produce boxes and bags for shipping produce, e.g., bananas, utilize ventilation structures that allow for ventilation therethrough. A method of assembling produce boxes provides for cutouts that serve as ventilation structures in the boxes. When the produce boxes are stacked such as on a shipping pallet, the ventilation structures allow for ventilation of through the stacked boxes. Produce may be packed in a bag, which is closed with a rip cord and inserted into a produce box. The rip cord may be accessed when the box is in a stack such as on a shipping pallet, such that the rip cord may be pulled thereby opening the bag, without removing the box from the stack.

20 Claims, 20 Drawing Sheets

Related U.S. Application Data

(60) Provisional application No. 62/625,588, filed on Feb. 2, 2018.

(51) Int. Cl.

| | |
|---|---|
| ***B65D 5/60*** | (2006.01) |
| ***B65D 33/16*** | (2006.01) |
| ***B65D 5/00*** | (2006.01) |
| ***B65D 85/34*** | (2006.01) |
| ***B65D 33/01*** | (2006.01) |
| ***B65D 5/68*** | (2006.01) |
| ***B65D 5/02*** | (2006.01) |
| ***B65D 5/20*** | (2006.01) |
| ***B65D 5/468*** | (2006.01) |
| ***B65D 33/28*** | (2006.01) |
| ***B65D 77/06*** | (2006.01) |

(56) References Cited

U.S. PATENT DOCUMENTS

| | | | | |
|---|---|---|---|---|
| 2005/0051450 | A1* | 3/2005 | Sanabria | B65D 85/345 206/503 |
| 2013/0302489 | A1* | 11/2013 | Marlin, Jr. | B65D 5/0015 206/386 |
| 2015/0115024 | A1* | 4/2015 | Finol | B65D 85/34 53/473 |
| 2015/0321832 | A1* | 11/2015 | Bankowski | B65D 85/345 206/423 |
| 2018/0009564 | A1* | 1/2018 | Carman | B65D 5/103 |

* cited by examiner

OPTIMIZED SYSTEM, BOX AND BAG FOR PACKING, SHIPPING, STORING AND DISPLAYING PRODUCE

PRIORITY

This application is a continuation of U.S. patent application Ser. No. 16/264,780, entitled "Optimized System, Box and Bag for Packing, Shipping, Storing and Displaying Produce," filed on Feb. 1, 2019, which claims priority to U.S. Provisional Patent Application No. 62/625,588, entitled "Optimized System, Box and Bag for Packing, Shipping, Storing and Displaying Produce," filed Feb. 2, 2018, the disclosure of which is incorporated herein by reference.

BACKGROUND

Perishable produce is often transported from where it is harvested to the point of sale. For this reason, produce is packaged in boxes that protect the produce during shipment, while allowing for sufficient ventilation of the produce to control air flow, moisture and/or ripening, which may impact shelf life.

Bananas may be packed and shipped in corrugated boxes, such as box 50 shown in FIG. 1A. For instance, box 50 comprises a base 51 and a lid 53 positionable over base 51. Base 51 and/or lid 53 typically comprise ventilation structures 57 (e.g., holes, cut-outs, etc.), on a side, top, and/or bottom surface of the base 51 and/or lid 53 to provide ventilation. For added protection of the bananas 100, a flexible plastic bag 54 comprising a plurality of ventilation slits may be placed in the base 51 of the box 50. Hands of bananas 100 are typically placed inside of the bag 54 in upper and lower rows. The lower rows may be covered with a paper tunnel pad to improve pack stability, and to protect the lower rows from damage, abrasion and/or scarring that could be caused by the two upper rows. Once the bananas 100 are packed into the bag 54, the plastic bag 54 is gathered and folded so that the unfilled portion of the bag 54 overlaps the fruit. In the alternative, the open edges of the bag 54 are gathered together and closed with twine 55 above the fruit as shown in FIG. 1A. The box 50 is then closed by telescopically sliding the lid 53 of the box over the base 51 of the box 50.

Once the box 50 is closed, it may be stacked onto a shipping pallet 52, along with other packed and closed boxes, as shown in FIG. 2. Referring to FIG. 1A, the lid 53 typically comprises flaps 59 extending along the length of each sidewall of the box 50, which are folded over to form the top surface of the lid 53. One or more boxes 50 can thereby be stacked on top of one another by placing the base 51 of a first box 50 onto the top surface formed by flaps 59 of a second box 50.

Boxes 50 are then stacked onto the shipping pallet 52 such that ventilation structures 57 in the boxes 50 align with each other. Alignment of ventilation structures of boxes when they are on the pallet, allows air to circulate through all of the boxes on the pallet, which in turn allows for an optimal banana temperature (for transportation, storage and ripening) to be reached, and provides for uniformity of the temperature across the pallet (thereby minimizing banana color differentials across the pallet). To keep the boxes 50 in place on the pallet 52 during shipment, plastic corner-boards and straps may be placed around the boxes 50 and the pallet 52 as is known in the art.

Once bananas (or other fruits) have been shipped to their destination, they may be ripened while on the pallets in a ripening room. Once the bananas are ripe, the straps and corner-boards may be removed from the pallet and the required number of boxes may be sent to the point of purchase. When the pallet arrives at a store, the plastic overwrap is opened and/or removed, to access the boxes. For example, FIG. 2 shows a shipping pallet 52 of prior art banana boxes 50 after the plastic overwrap (not shown) has been removed.

To display bananas, a prior art banana box 50 may be removed from the pallet 52 and the lid 53 of the box 50 may be cut open, or in the alternative, the lid 53 can be removed and inverted and the base 51 of the box 50 can be telescopically slid into the lid 53. The plastic bag 54 inside the box 50 may then be opened. The opened plastic bag 54 may be draped over the sides of the box 50 to return the box 50 to the opened configuration, as shown in FIG. 1B, so the bananas 100 can be easily removed from the box 50.

An exemplary display 1100 of bananas 100 in a store is shown in FIG. 3. As bananas 100 are sold, bananas are replenished on the display 1100 throughout the course of the day. To make the re-stocking process easier, opened boxes 50 may be stored at or near the display 1100, or under the display 1100 as shown in FIG. 3. If there is not sufficient space to store some or all of the opened boxes 50 near the display 1100, then some or all of the opened boxes 50 may be stored on the shipping pallet 52 until needed. To keep the stored bananas from ripening prematurely and shortening their shelf-life, each opened box 50 is re-placed onto the shipping pallet 52 in a cross-stack as shown in FIG. 4.

The steps of removing an overwrap from a pallet load of boxes, removing boxes from the pallet, opening the boxes and the plastic bags contained therein to prepare the boxes, and, in some instances, cross-stacking the prepared boxes back onto the pallet is labor intensive and time consuming. Thus, there is a need for an improved banana box and plastic bag that allows for maintenance of favorable shipping and storage conditions, while providing for improved handling and storage at the point of purchase. The need is particularly felt for bananas, but also applies to other produce, including other fruits and vegetables, which require similar handling, and may also have varying requirements during the packing, shipping and storing processes.

DETAILED DESCRIPTION

Figure 1A:
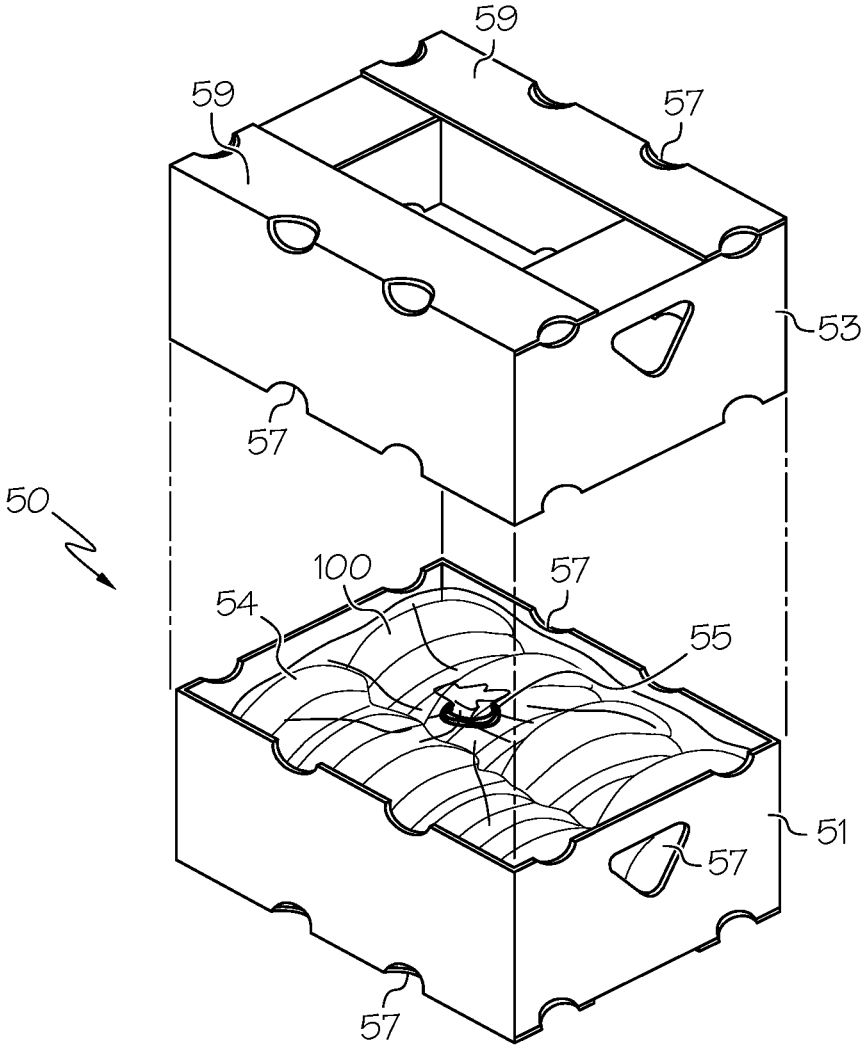
FIG. 1A (PRIOR ART)
FIG. 1A is a perspective exploded view of a prior art produce box.
Figure 1B:
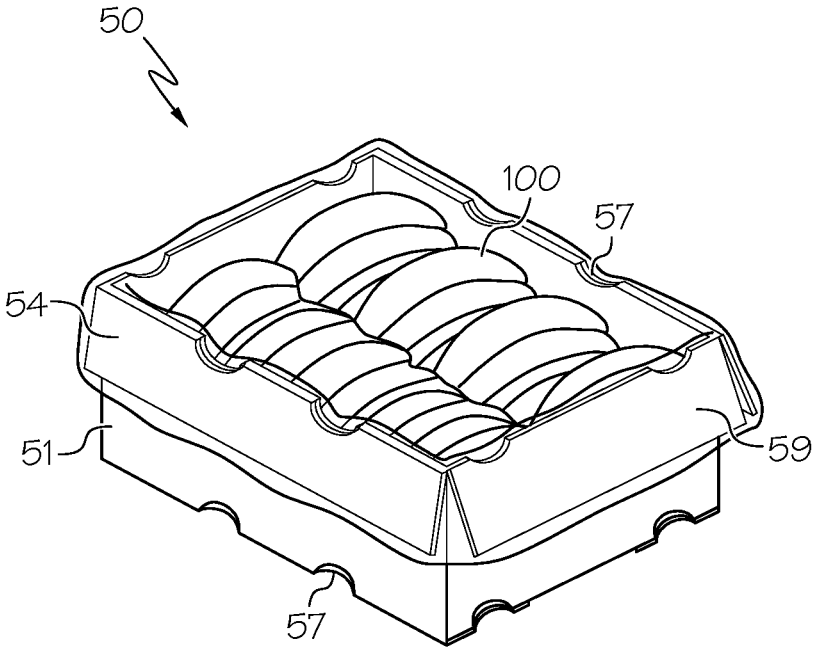
FIG. 1B (PRIOR ART)
FIG. 1B is a perspective view of the prior art produce box of FIG. 1A in an opened configuration.
Figure 2:
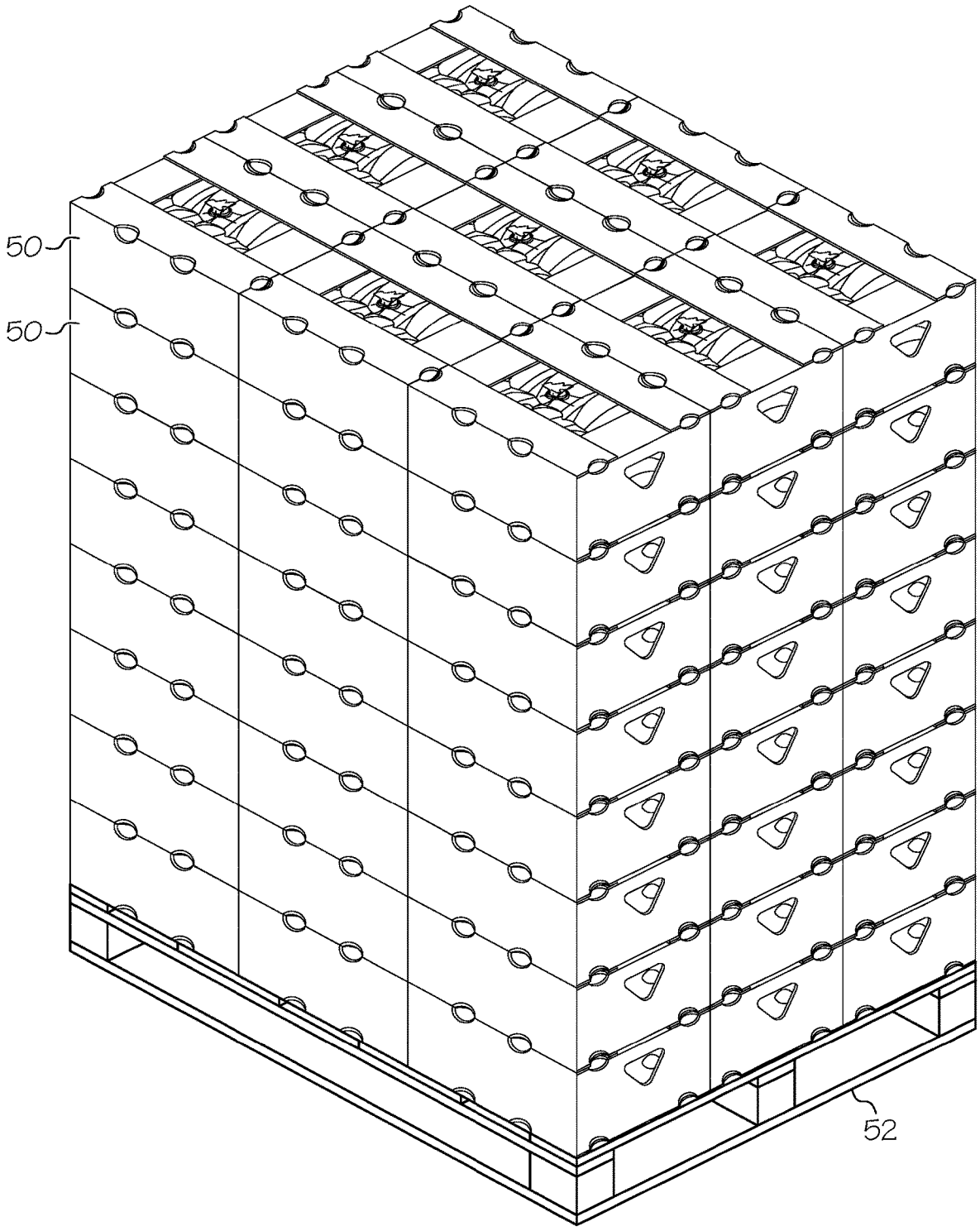
FIG. 2 (PRIOR ART)
FIG. 2 is a perspective view of a plurality of the prior art produce boxes of FIG. 1A stacked on a shipping pallet.
Figure 3:
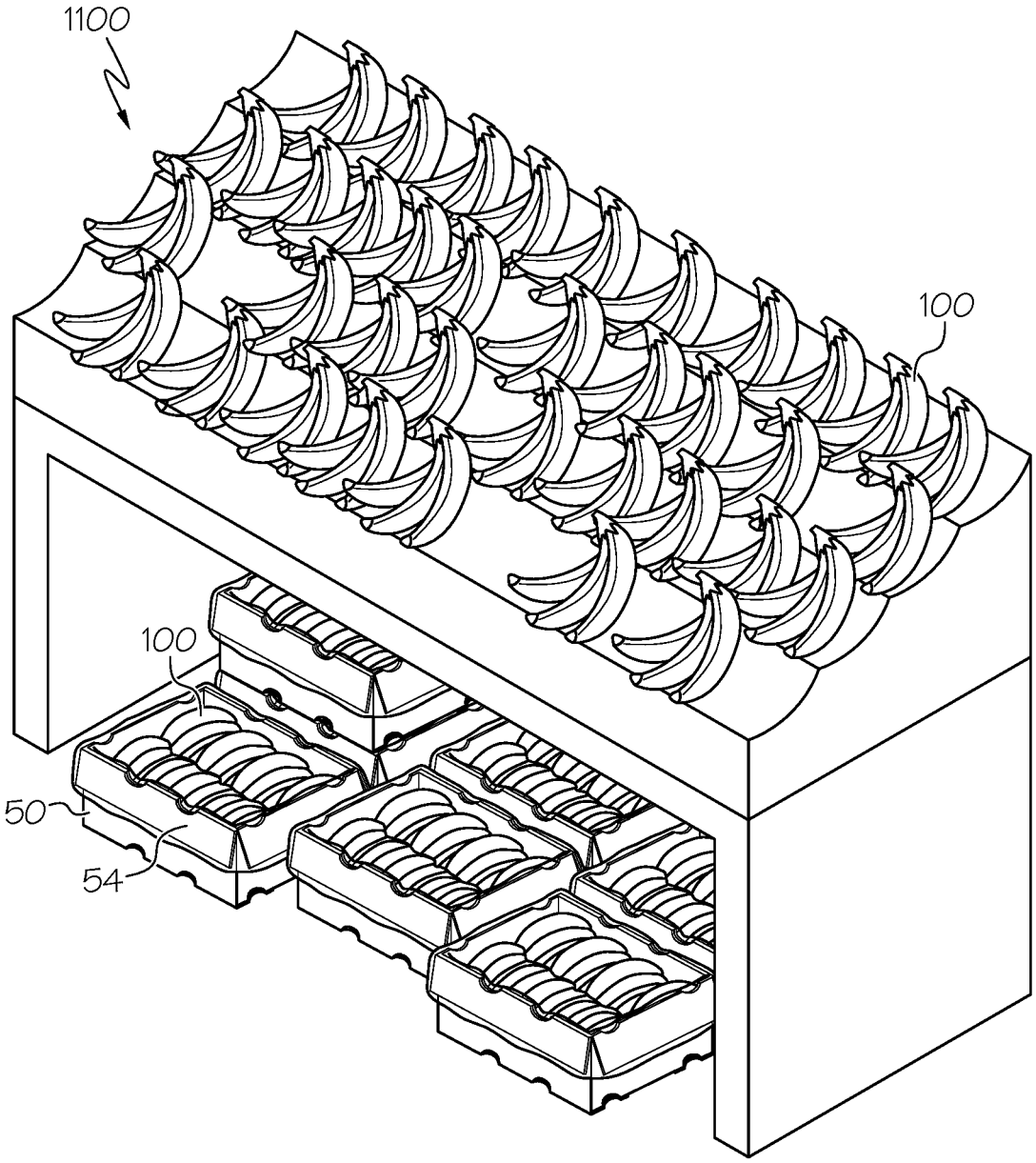
FIG. 3 (PRIOR ART)
FIG. 3 is a perspective view of a display of bananas at a point of purchase and a stock of bananas under the display in the prior art produce box of FIG. 1B.
Figure 4:
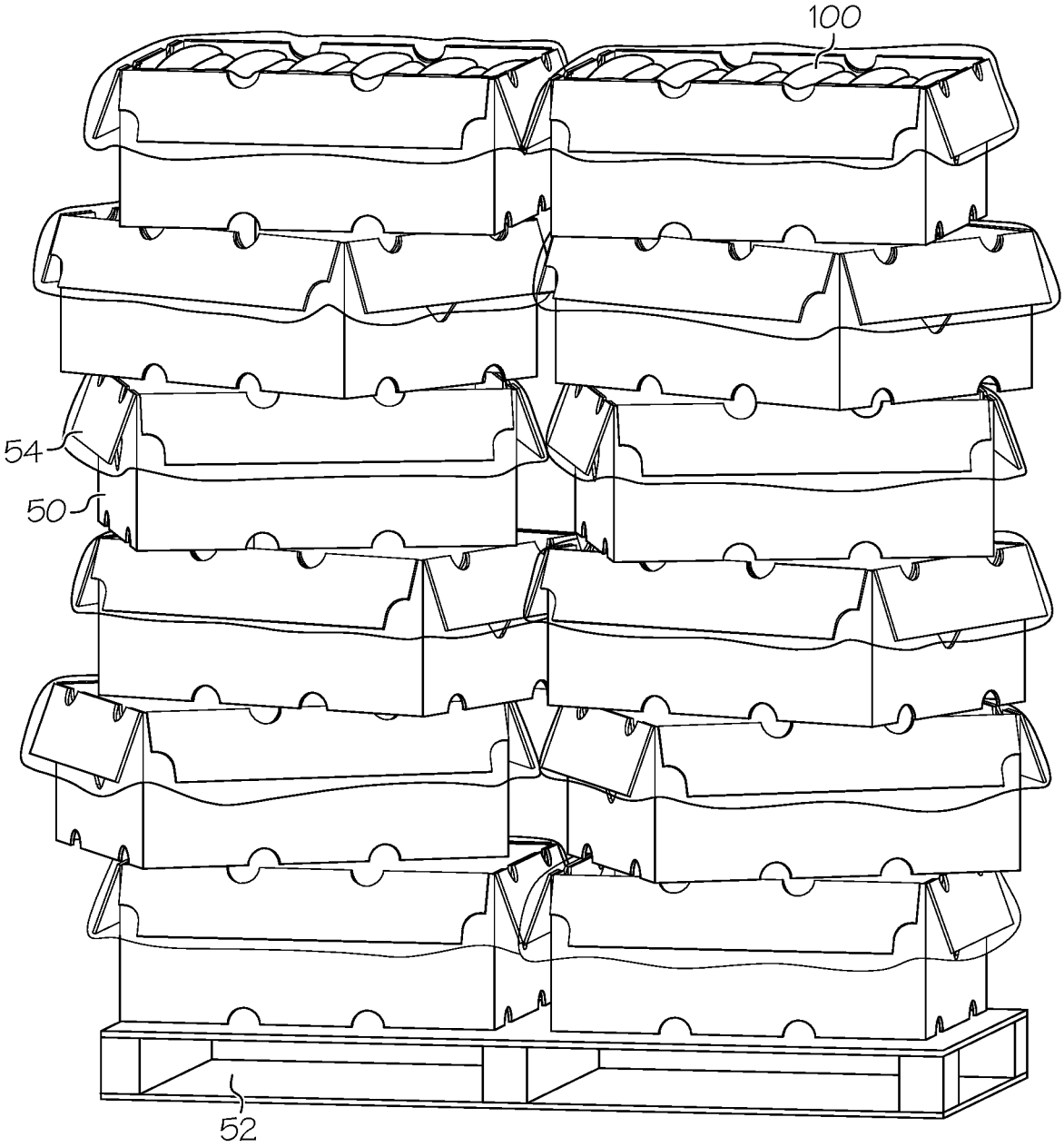
FIG. 4 (PRIOR ART)
FIG. 4 is a perspective view of the prior art produce box of FIG. 1B cross-stacked back onto a pallet.

The present disclosure is directed to improved boxes, improved plastic bags, systems comprising them and methods of their use. As described in further detail below, the boxes comprise a substantially rigid outer lid portion and a substantially rigid base portion. When in an assembled state, the lid portion of the box telescopically slides over the base portion of the box. The lid portion of the box comprises corner tabs that are joined together to form platforms supported by the side walls of the lid portion. The platforms provide a surface onto which other boxes may be stacked, such as on a pallet. The platforms and tops of the side walls of the box define an opening in the lid portion, such that produce (e.g., bananas) inside the box are visible and/or accessible through the opening, in contrast to the prior art box, which requires removal of the lid portion of the box to access the produce (e.g., bananas) that are inside the box.

In accordance with the present disclosure, bananas may be packed into an improved bag that is draped over the sides of the base of the box during the packing process as described above. Once the bananas are packed into the bag, it is closed using a ripcord that is tied in a knot around the opening in the bag. The improved bag comprises perforations as described below, that allow the bag to easily be opened by pulling on the ripcord. One or more ends of the ripcord may extend through an opening (e.g., a handle) of the box, thereby allowing the bag to be opened without opening the box.

The improved box and bag may provide the following advantages:

Like prior art produce boxes and bags, the improved box and bag protect bananas during shipment, while allowing for adequate ventilation through the box and bag, and throughout the stacked boxes on a pallet. At the point of purchase, and after the plastic overwrap has been cut open and/or removed from the palletized boxes, the bags in the boxes may be opened by pulling the ripcords extending through an opening (e.g., the handle) of the box. Thus, the improved box and bag eliminate the need to remove each box from the pallet and/or to open the box, prior to opening the bag. Since there is adequate ventilation throughout the ventilation structures of the improved boxes when they are stacked boxes on a pallet, there is no need to remove the boxes from the pallet, open them, open the bags and then cross-stack the boxes back onto the pallet for storage. But rather, to store bananas in improved boxes on a pallet at the point of purchase, only two steps are needed, removal or opening of the plastic overwrap from the pallet and pulling the ripcord to open each of the improved bags, while leaving the improved boxes closed and stacked on the pallet.

As described below, some exemplary boxes comprise an opening in its top portion that is large enough to permit removal of the bananas from the box without opening the box, such as by cutting it open, or removing the lid. Bananas packed inside these exemplary boxes may be readily removed from the box by simply pulling the ripcord to open the improved bag. Thus, these exemplary boxes can be moved from a pallet nearer to the point of purchase display and bananas readily removed therefrom, without any further processing of the box, including opening the box.

Reference will now be made in detail to the aspects of the disclosure, examples of which are illustrated in the accompanying drawings, wherein like numerals indicate the same elements throughout the views.

Figure 5:
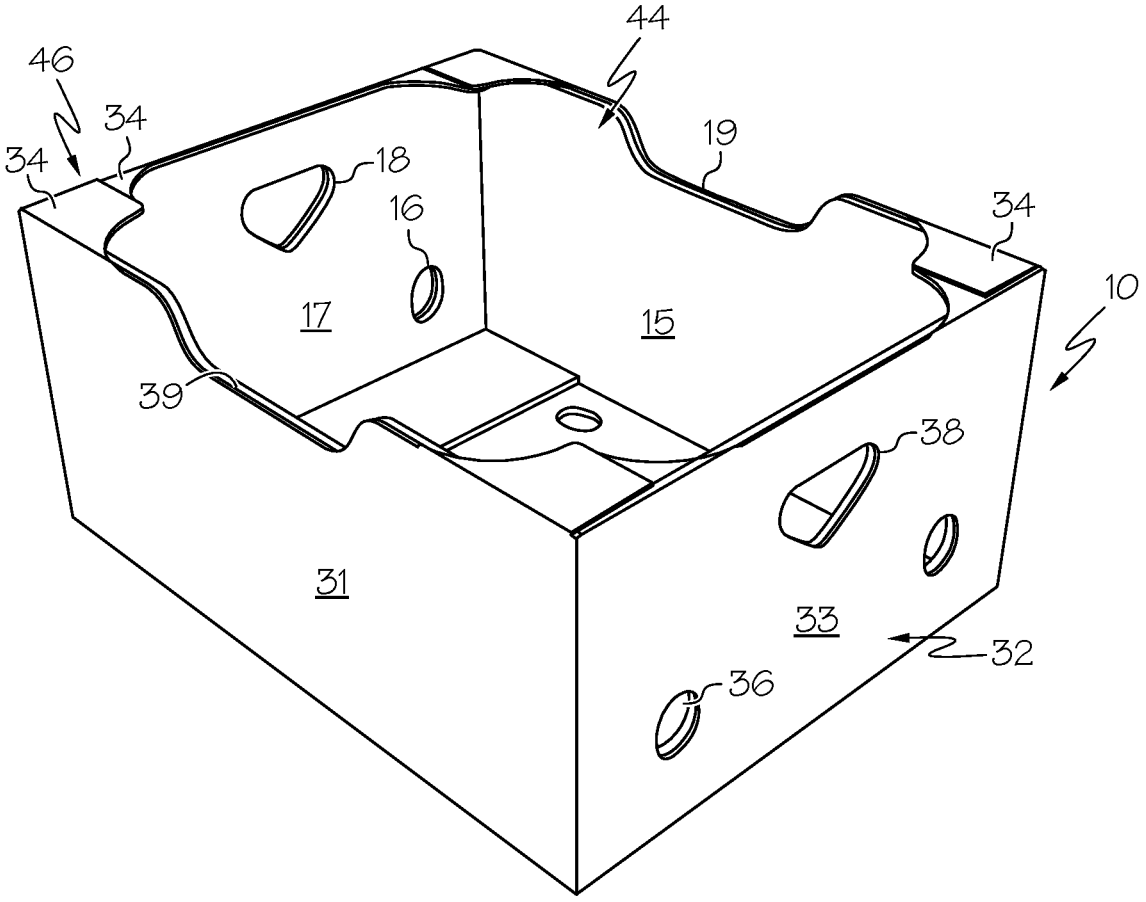
FIG. 5 is a top perspective view of a first exemplary produce box per the present disclosure.
Figure 6:
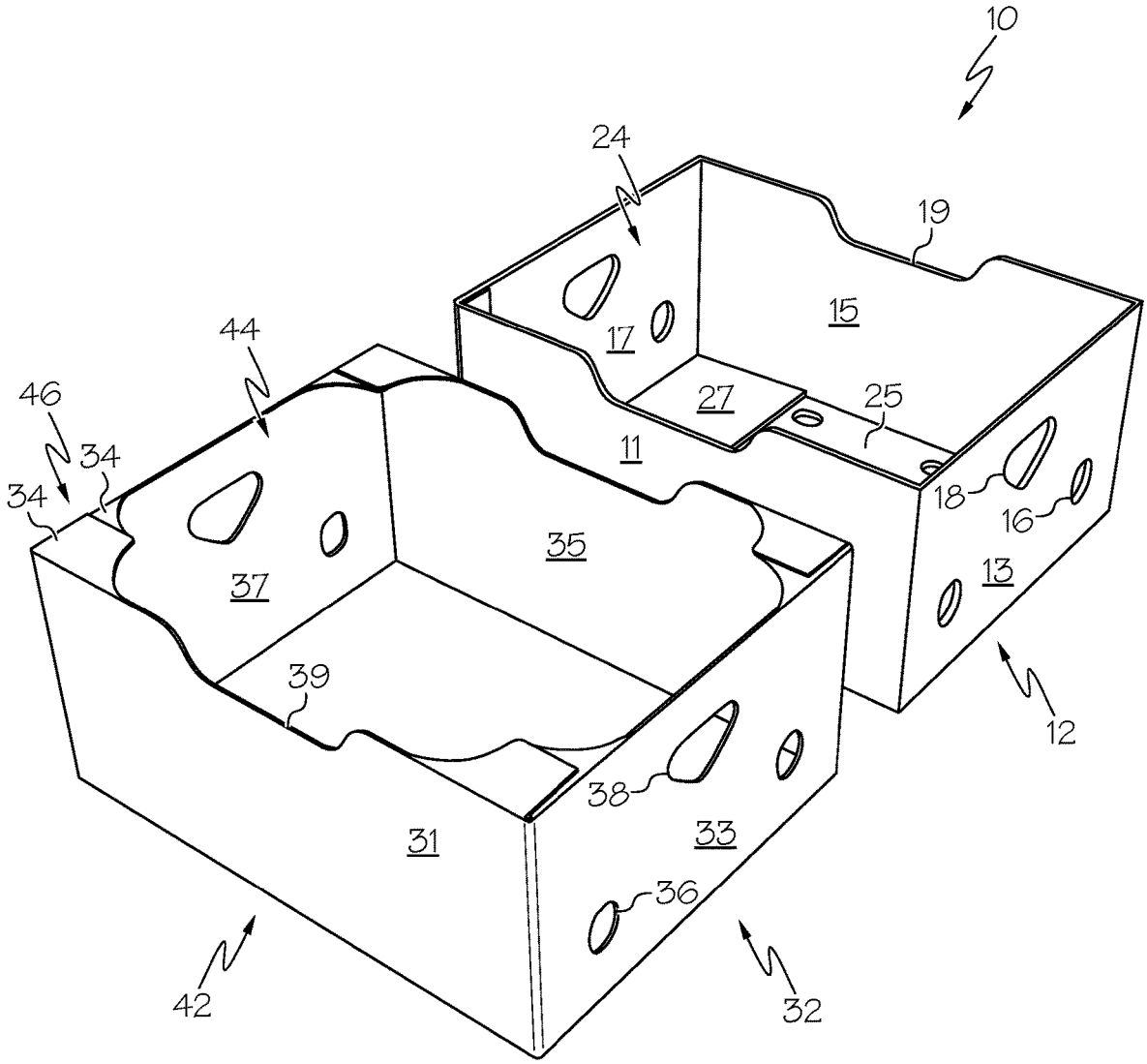
FIG. 6 is an exploded view of the produce box of FIG. 5.

Referencing FIGS. 5-6, an exemplary box 10 for produce, particularly bananas, is provided. Produce box 10 comprises a base 12 and a lid 32 that may be positioned over base 12. Each of these components will be discussed in more detail below.

Figure 7:
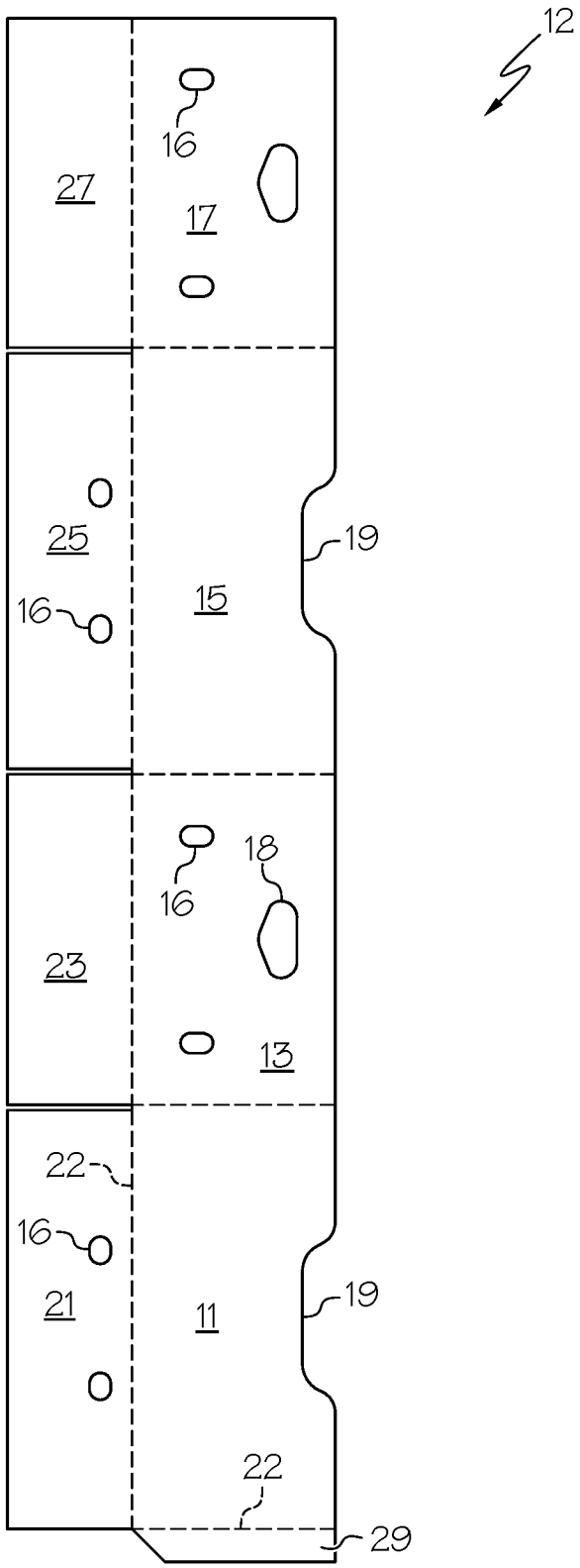
FIG. 7 is a top plan view of an unassembled base of the produce box of FIG. 5.

FIG. 7 shows base 12 of produce box 10 in an unassembled state. In the unassembled state, the base 12 comprises a first side panel 11, a front panel 13, a second side panel 15 and a rear panel 17 aligned longitudinally with each other. Each panel 11, 13, 15, 17 comprises a respective flap 21, 23, 25, 27 extending outwardly from each panel 11, 13, 15, 17. In the illustrated example, the flaps 21, 23, 25, 27 each extend from the bottom edge of each panel 11, 13, 15, 17 such that each flap 21, 23, 25, 27 is longitudinally aligned with each other. A tab 29 is further positioned adjacent to the first side panel 11. In the illustrated example, a score line 22 is provided between each panel 11, 13, 15, 17, flap 21, 23, 25, 27, and tab 29 to allow for easier assembly of base 12.

Figure 11:
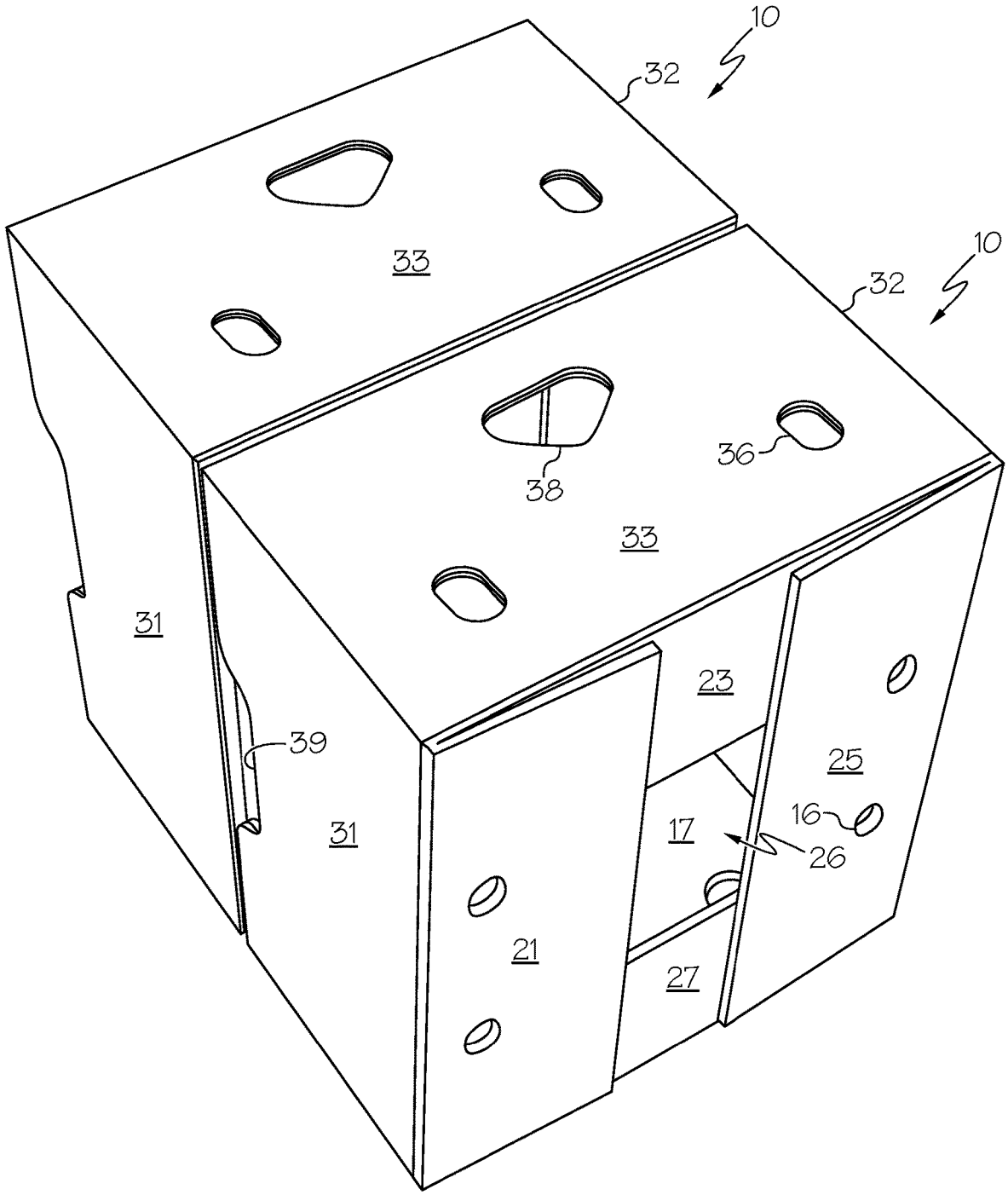
FIG. 11 is a bottom perspective view of the plurality of the produce boxes of FIG. 5 stacked on top of one another.

To assemble base 12, as shown in FIG. 6, the panels 11, 13, 15, 17 are folded along the score lines 22 such that the side panels 11, 15 are substantially parallel with each other and the front and rear panels 13, 17 are substantially parallel with each other. Tab 29 may be folded inwardly and positioned against the interior surface of rear panel 17. In some versions, tab 29 is adhered to the rear panel 17 to maintain the base 12 in an assembled configuration. Panels 11, 13, 15, 17 thereby form an opening 24 through the top surface of the base 12. The flaps 21, 23, 25, 27 are then folded inward and secured (e.g., glued) to one another in order to form a bottom surface of the base 12. As can be seen in FIG. 11, when exemplary base 12 is assembled, flaps 21, 23, 25, 27 define an opening 26 in the bottom surface of the base 12, which aids in ventilation of the box 10 taken alone or stacked on a pallet with other boxes. Base 12 may be folded and glued at a packing station in a Manufacturing Join at Box Plant.

At least one ventilation aperture 16 is located in the flaps 21, 23, 25, 27 and/or on the panels 11, 13, 15, 17 of the base 12, and/or at least one ventilation cutout 19 is located on the panels 11, 13, 15, 17. For instance, as shown in FIGS. 6 and 7, each of the side panels 11, 15 comprise a ventilation cutout 19 extending inwardly from a top edge of the side panels 11, 15. Cutouts 19 have a generally rectangular shape with or without rounded corners. Other suitable shapes can be selected from square, triangular or trapezoidal. Such cutouts may extend along from about 30% to about 55% or from about 35% to about 50% of the length of each panel 11, 15. Some exemplary cutouts may extend along about 35% or about 50% of the length of each panel 11, 15. These cutouts 19 may allow air to flow through the cutouts 19 and laterally across a top portion of the box 10 to ventilate the box 10 when a plurality of boxes 10 are assembled and stacked on top of each other. While the cutouts 19 are shown on each of the side panels 11, 15, cutouts 19 may be positioned on any one or more of the panels 11, 13, 15, 17 of produce box 10. In the illustrated example, base 12 further comprises one or more apertures 16 on the front panel 13, rear panel 17, and flaps 21, 25. This may provide for further ventilation of box 10. Handholds (i.e., "handles") 18 may also be provided for additional ventilation, and/or for ease of transporting the box 10. Still other suitable ventilation configurations will be apparent to one with ordinary skill in the art in view of the teachings herein.

Figure 8:
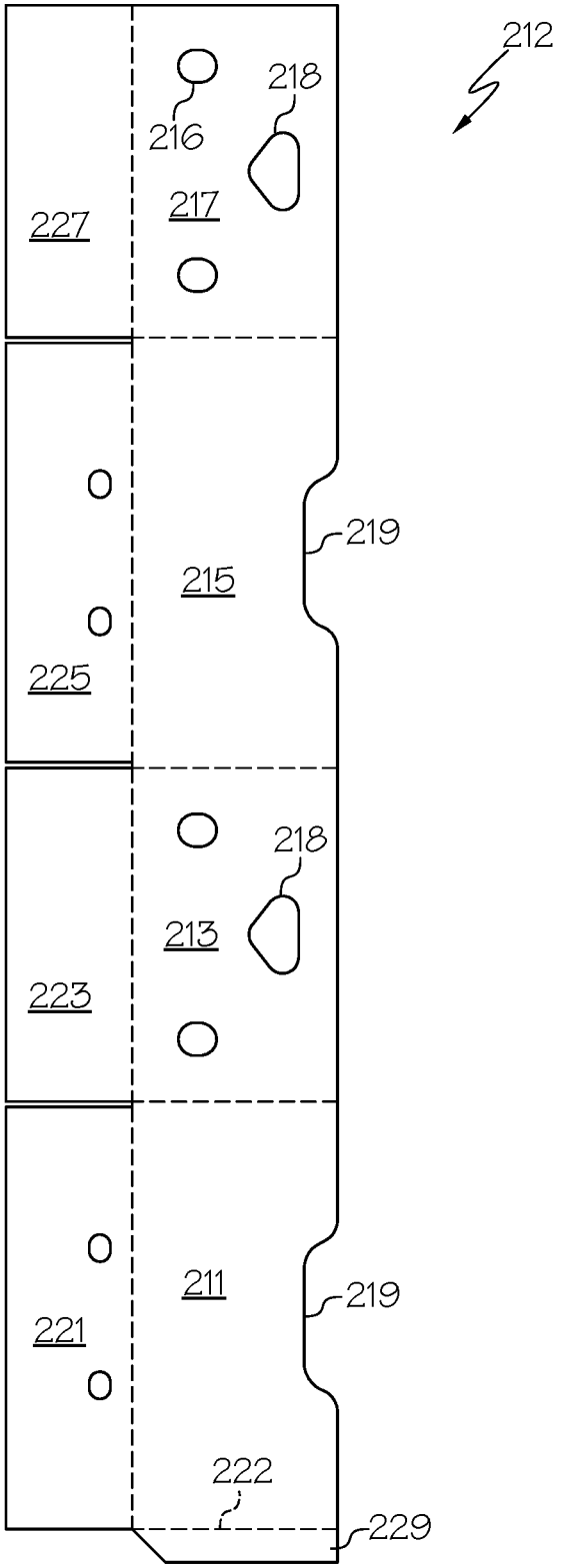
FIG. 8 is a top plan view of another unassembled base for use with the produce box of FIG. 5.

For instance, FIG. 8 is an unassembled view of another exemplary base 212 that is similar to base 12, except that base 212 comprises larger ventilation apertures 216 and handholds 218.

Figure 9:
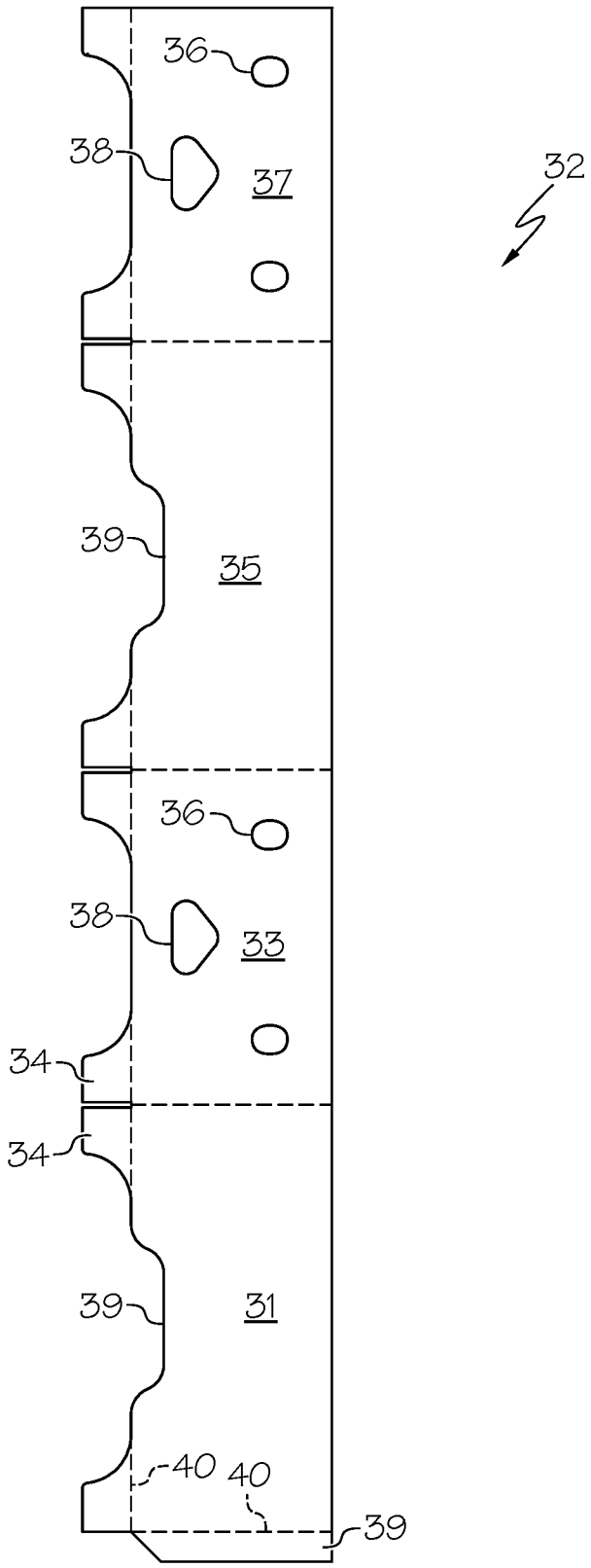
FIG. 9 is a top plan view of an unassembled lid of the produce box of FIG. 5.

FIG. 9 shows the lid 32 of the produce box 10 in an unassembled state. In the unassembled state, the lid 32 comprises a first side panel 31, a front panel 33, a second side panel 35 and a rear panel 37 aligned longitudinally with each other. Each panel 31, 33, 35, 37 comprises a tab 34 extending outwardly from each corner of the top edge of each panel 31, 33, 35, 37. While the illustrated example shows each tab 34 comprising a square portion with an arcuate portion extending from an interior top edge of the square portion of the flap 34 inwardly to the top edge of the panel 31, 33, 35, 37, other suitable shapes can be used. Each square portion of the tab 34 may have a width of about 2.5 inches and a length of about 2.5 inches, but other suitable dimensions can be used. For instance, each tab 34 may extend up to about 25% of the length of each panel 31, 33, 35, 37. A tab 39 is further positioned adjacent to the first side panel 31. In the illustrated example, a score line 40 is provided between each panel 31, 33, 35, 37 and tabs 34, 39 to allow for easier assembly of lid 32.

To assemble lid 32, as shown in FIG. 6, the panels 31, 33, 35, 37 are folded along the score lines 40 such that the side panels 31, 35 are substantially parallel with each other and the front and rear panels 33, 37 are substantially parallel with each other. Tab 39 may be folded inwardly and positioned against the interior surface of rear panel 37. In some versions, tab 39 is adhered to the rear panel 37 to maintain the lid 32 in an assembled configuration. Panels 31, 33, 35, 37 thereby form an opening 44 through the bottom surface of the lid 32. The tabs 34 are then folded inward and secured (e.g., glued) to one another in order to form a corner 46 on each corner of the lid 32 to form a top surface of the lid 32. As can be seen in FIG. 6, when exemplary lid 32 is assembled, corners 46 define an opening 44 in the top surface of the lid 32, which aids in ventilation of the box 10 taken alone or stacked on a pallet with other boxes. In the illustrated example, the opening 44 comprises about 90% of a top surface of the lid 32, but other suitable configurations can be used. Lid 32 may be folded and glued at a packing station in a Manufacturing Join at Box Plant.

At least one ventilation aperture 36 is located in the panels 31, 33, 35, 37 of the lid 32, and/or at least one ventilation cutout 39 is located on the panels 31, 33, 35, 37. For instance, as shown in FIGS. 6 and 7, each of the side panels 31, 35 comprise a ventilation cutout 39 extending inwardly from a top edge of the side panels 31, 35. Cutouts 39 have a generally rectangular shape with or without rounded corners. Other suitable shapes can be selected from square, triangular or trapezoidal. Such cutouts may extend along from about 30% to about 55% or from about 35% to about 50% of the length of each panel 31, 35. Some exemplary cutouts may extend along about 35% or about 50% of the length of each panel 31, 35. These cutouts 39 may allow air to flow through the cutouts 39 and laterally across a top portion of the box 10 to ventilate the box 10 when a plurality of boxes 10 are assembled and stacked on top of each other. While the cutouts 39 are shown on each of the side panels 31, 35, cutouts 39 may be positioned on any one or more of the panels 31, 33, 35, 37 of produce box 10. In the illustrated example, lid 32 further comprises one or more apertures 36 on the front panel 33 and rear panel 37. This may provide for further ventilation of box 10. Handholds (i.e., "handles") 38 may also be provided for additional ventilation, and/or for ease of transporting the box 10. Still other suitable ventilation configurations will be apparent to one with ordinary skill in the art in view of the teachings herein.

In some examples, lid 32 and base 12 are of approximately equal score to score depth as shown in FIG. 5. To assemble box 10, lid 32 telescopically slides over base 12. Accordingly, the first side panel 31 of the lid 32 is positioned over the first side panel 11 of the base 12, the front panel 33 of the lid 32 is positioned over the front panel 13 of the base 12, the second side panel 35 of the lid 32 is positioned over the second side panel 15 of the base 12, and the rear panel 37 of the lid 32 is positioned over the rear panel 17 of the base 12. This aligns the top opening 44 of the lid 32 with the top opening 24 of the base 12 and the bottom opening 42 of the lid 32 with the bottom opening 26 of the base 12. Ventilation cutouts 19, 39, apertures 16, 36, and handholds 18, 38 of the base 12 and lid 32 are also aligned with each other to provide ventilation through the box 10.

In the assembled state, box 10 may be about 19 and ⅞ inches long by about 15 9/16 inches wide by about 9 and ¾ inches high, within a manufacturing tolerance of about ±0.1 inches, or about ±0.06 inches. Still other suitable dimensions can be used that will be apparent to one with ordinary skill in the art in view of the teachings herein. For instance, exemplary boxes may have defined dimensions such that the boxes may fit snugly on a pallet without overhanging the edges of the pallet, thereby protecting the fruit from damage during shipping. The boxes 10 are generally made from corrugated cardboard, but can be made from any material typically used for making shipping boxes. The choice of material is governed by such factors as cost and strength/durability.

Figure 10:
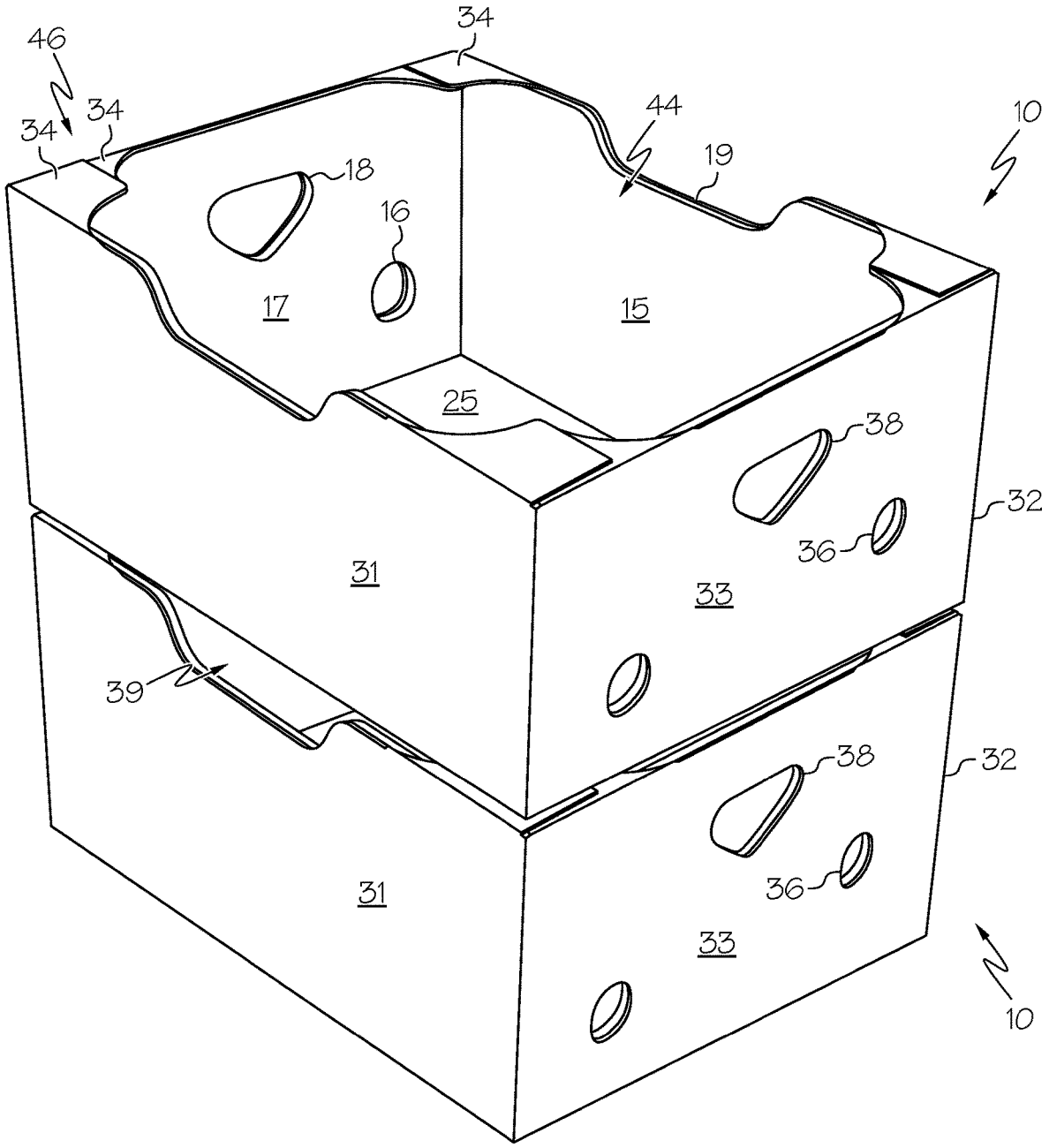
FIG. 10 is a top perspective view of a plurality of the produce boxes of FIG. 5 stacked on top of one another.

Once assembled, the boxes 10 may be stacked on top of each other in a stacked configuration (FIGS. 10 and 11) such that a bottom surface of a base 12 is positioned on a top surface of a lid 32 of a box 10. In the illustrated example, the top surface of the lid 32 is defined by the top surface of the corners 46 formed by the folded flaps 34 of the lid 32. The top surface of the corners 46 may thereby provide a surface area to receive the bottom portion of another box 10 such that one or more additional boxes may be stacked, such as on a pallet. Accordingly, the corners 46 may be formed such that the corners 46 are sufficiently strong enough to support the weight of another box 10 stacked on top of the corners 46 of a lid 32 such that the corners 46 maintain their shape in a stacked configuration without deforming the box 10. Produce, e.g., bananas, may be seen through and/or removed from an assembled box 10 through the opening 44 in the lid 32.

The boxes 10 of the present disclosure include an improved ventilation system. Referencing FIGS. 10 and 11, boxes 10 are structured so that air can circulate through all of the boxes 10 when they are stacked on top of each other, such as on a shipping pallet. This can allow for the boxes to be stacked on a pallet, e.g., in 8 layers of 6 boxes for a regular shipping pallet, or in 4 layers of 6 boxes for a "half-pallet," while allowing for adequate ventilation through the palletized boxes. Ventilation and air flow serve two important functions with regard to boxes 10 stacked on a shipping pallet: (1) they allow for efficient air flow which may provide an optimal banana temperature (for transportation, storage and ripening) to be reached; and (2) they provide for uniformity of that temperature across the pallet (thereby minimizing banana color differentials across the pallet). Ventilation and air flow are usually achieved by placing apertures and/or cutouts in boxes which are not blocked (and allow air flow) when individual boxes are stacked on top of each other and adjacent to one another. Examples of such banana boxes ventilation systems, which may be of use in the improved systems of the present disclosure, are described in PCT Published Patent Application WO 2004/045972, published Jun. 3, 2004; and U.S. Published Patent Application 2003/0198714, published Oct. 23, 2003; each of which are incorporated by reference herein.

Figure 12:
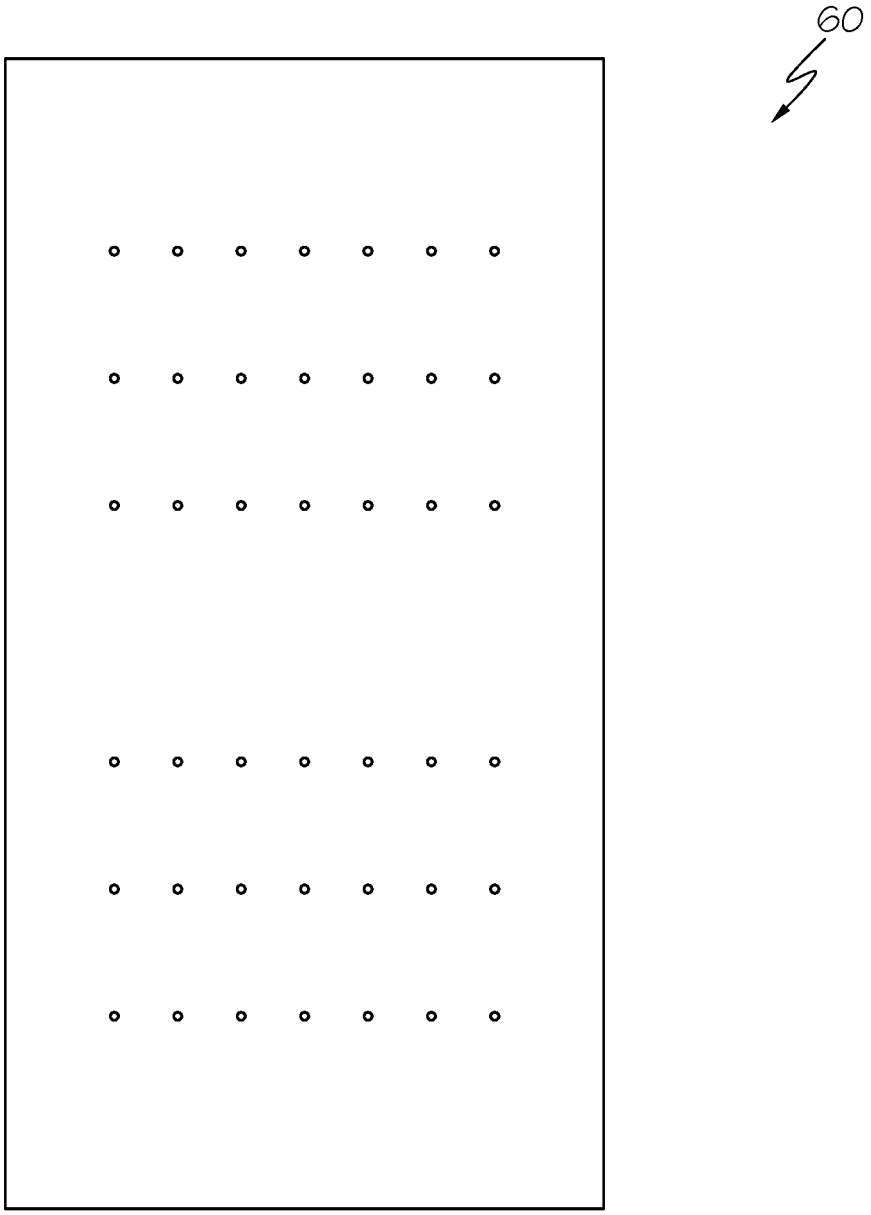
FIG. 12 is a top plan view of a tunnel pad for use with the produce box of FIG. 5.

Produce, particularly bananas, may be packed into the improved boxes in any suitable fashion. For example, hands of bananas may be packed in four rows, which in turn comprises two lower and two upper rows. The two lower rows may be covered with a paper tunnel pad to improve pack stability, and to protect the lower rows from damage, abrasion and/or scarring that could be caused by the two upper rows. Referencing FIG. 12, an exemplary tunnel pad 60 of use is shown. Exemplary tunnel pads which may be of use in the improved boxes are described in PCT Published Patent Application WO 2004/045972, which is incorporated herein by reference.

When perishable produce, such as bananas, is shipped in a box, a flexible plastic inner wrap or bag is typically employed to protect the produce and/or and to control fruit dehydration. This inner wrap may be a bag made of plastic with a plurality of ventilation slits provided about the surface of the bag. The bag is typically placed in the base portion of a box, and the open edges of the bag are draped over its sidewalls. In this fashion, fruit, such as bananas, placed inside the bag, such as by being layered therein. Once fruit is packed into the bag, the plastic bag may be gathered and folded so that the unfilled portion of the bag overlaps the fruit. In the alternative, the open edges of the bag 54 may be gathered together and closed with twine 55 above the fruit (for example, as shown in relation to the prior art box and plastic bag 54 in FIG. 1A).

Figure 13:
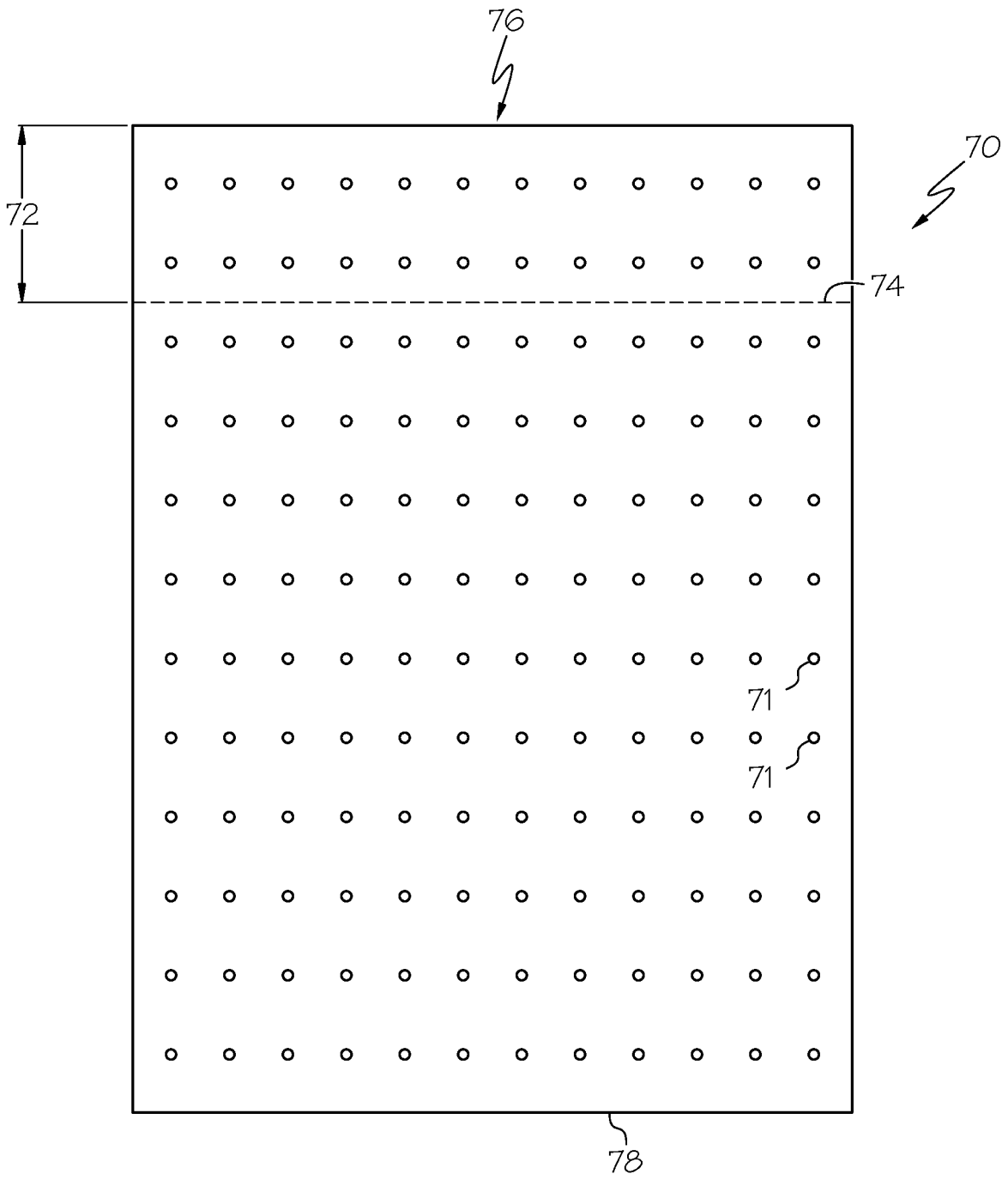
FIG. 13 is a top plan view of a bag for use with the produce box of FIG. 5.

Improved plastic bag 70 according to the present disclosure is shown in FIG. 13. As can be seen in FIG. 13, improved plastic bag 70 comprises an open top end 76, a closed bottom end 78, and a plurality of perforations 71 through the sidewalls of the bag 70. Perforations 71 aid in ventilation of produce contained within bag 70 which helps to control humidity, temperature and color of the fruit. A neck 72 is provided at the top portion of the bag 70 adjacent to open top end 76, defined above perforation line 74. Perforation line 74 acts as a line of weakness so that the bag 70 may be easily opened by pulling a ripcord 80 that has been tied around neck 72 of bag 70 as described below. When the ripcord 80 is pulled the neck 72, or top portion of the bag 70, is easily torn and/or removed. This feature of improved bag 70 may be particularly advantageous since it allows the box 10 to be easily opened at the point of purchase without being removed from a stack of boxes. Improved bag 70 may be filled with bananas prior to box 10 being assembled as shown in FIG. 5.

Figure 14:
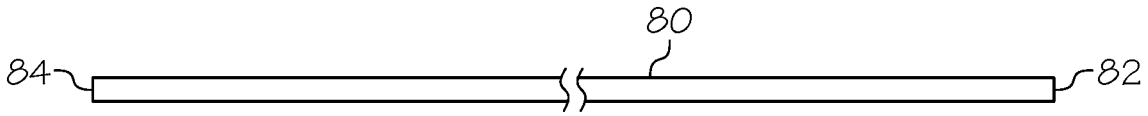
FIG. 14 is a top plan view of a ripcord for use with the bag of FIG. 13.
Figure 15:
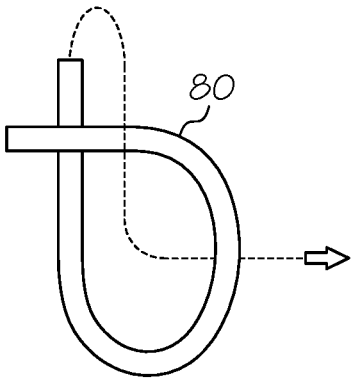
FIG. 15 is a front view of the ripcord of FIG. 14 being tied into a knot using a first method.
Figure 16:
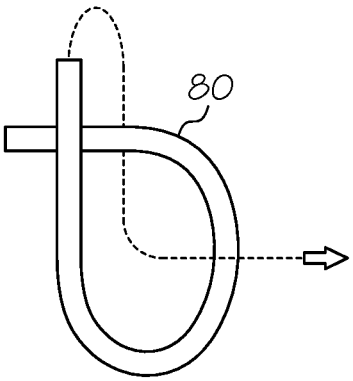
FIG. 16 is a front view of the ripcord of FIG. 14 being tied into a knot using a second method.
Figure 17:
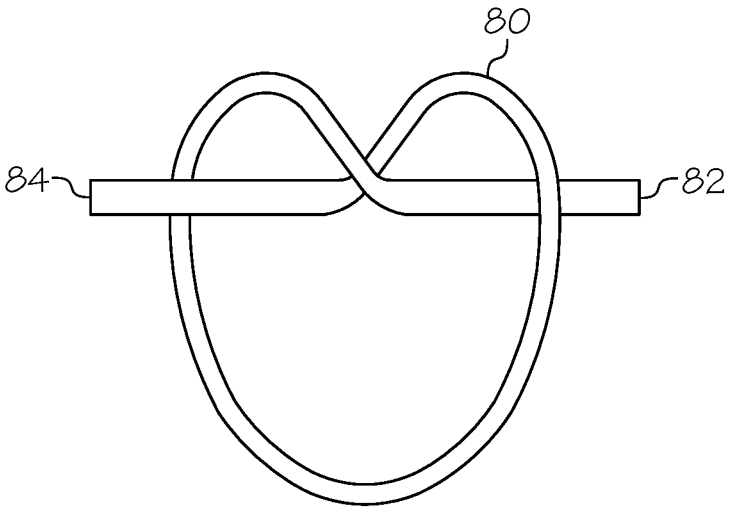
FIG. 17 is a front view of the ripcord of FIG. 14 tied into a knot.

An exemplary ripcord 80 is shown in FIG. 14 having a first end 82 and a second end 84. Ripcord 80 may be made from any suitable material so long as it has the strength to secure closure of plastic bag 70 until such time as it is opened at the point of purchase. Ripcord 80 may be tied about neck 72 of bag 70 to form a knot 86, as shown in FIG. 17, about neck 72. Knot 86 may be formed in any suitable fashion, such as the methods shown in FIGS. 15 and 16. FIG. 15 shows knot 86 being formed by looping the first end 82 of ripcord 80 behind the second end 84 and threading the first end 82 through the loop. FIG. 16 shows knot 86 being formed by looping the first end 82 of ripcord 80 in front of the second end 84 and threading the first end 82 through the loop. Still other suitable methods to form knot 86 will be apparent to one with ordinary skill in the art in view of the teachings herein.

Figure 18:
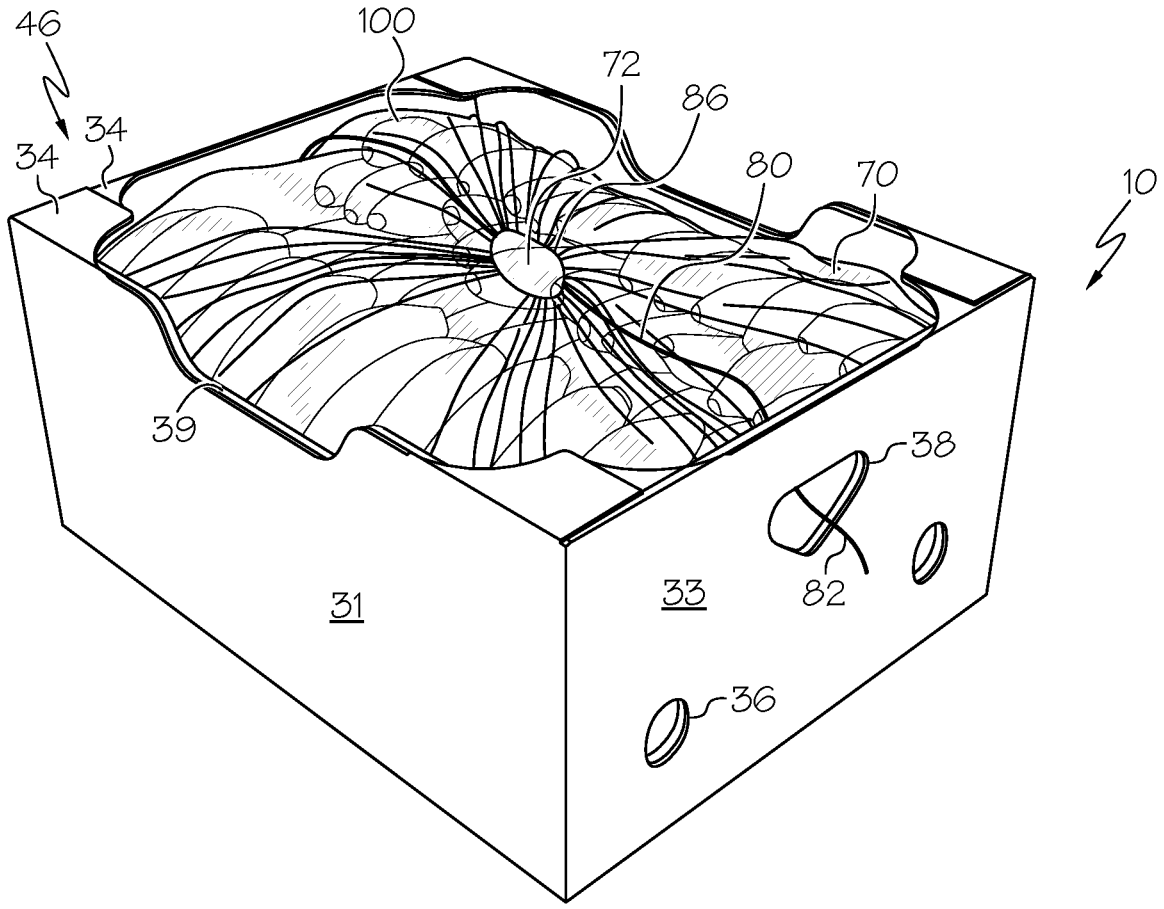
FIG. 18 is a top perspective view of the produce box of FIG. 5 storing a closed bag of bananas.

Referring to FIG. 18, once plastic bag 70 is filled with bananas it is secured in a closed position with ripcord 80. For instance, ripcord 80 is tied around the neck 72 of plastic bag 70 in a knot 86 that secures plastic bag 70 in a closed position. An end 82 of ripcord 80 is passed through an opening in the box 10 (e.g., handle 18) so that it may readily be accessed even when box 10 is stacked on a pallet and/or has another box stacked on its top. The end 82 of ripcord 80 may then be pulled from the exterior of the box 10 to open the bag 70. The force of pulling ripcord 80 results in tearing along perforation line 74 such that a top portion of the improved bag 70 is removed, thereby opening the bag 70. Accordingly, the bag 70 can be opened without accessing the interior portion of the box 10 such that the bag 70 may be opened while the box 10 is in a stacked configuration.

FIGS. 19-23 show another example of a produce box 110 that is similar to produce box 10, except that produce box 110 comprises ventilation cutouts in the flaps of the lid. Similar to produce box 10, produce box 110 comprises a base 112 and a lid 132 that may be positioned over base 112. Each of these components will be discussed in more detail below.

Figure 21:
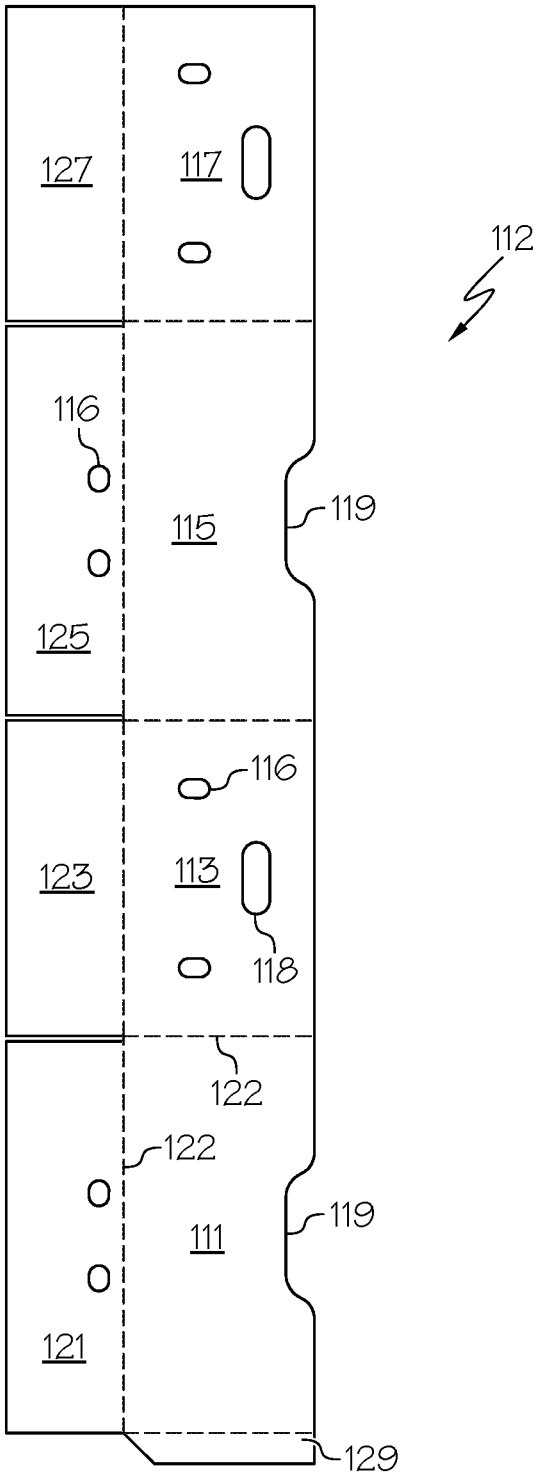
FIG. 21 is a top plan view of an unassembled base of the produce box of FIG. 19.

FIG. 21 shows base 112 of produce box 110 in an unassembled state. In the unassembled state, the base 112 comprises a first side panel 111, a front panel 113, a second side panel 115 and a rear panel 117 aligned longitudinally with each other. Each panel 111, 113, 115, 117 comprises a respective flap 121, 123, 125, 127 extending outwardly from each panel 111, 113, 115, 117. In the illustrated example, the flaps 121, 123, 125, 127 each extend from the bottom edge of each panel 111, 113, 115, 117 such that each flap 121, 123, 125, 127 is longitudinally aligned with each other. A tab 129 is further positioned adjacent to the first side panel 129. In the illustrated example, a score line 122 is provided between each panel 111, 113, 115, 117, flap 121, 123, 125, 127, and tab 129 to allow for easier assembly of base 112.

Figure 20:
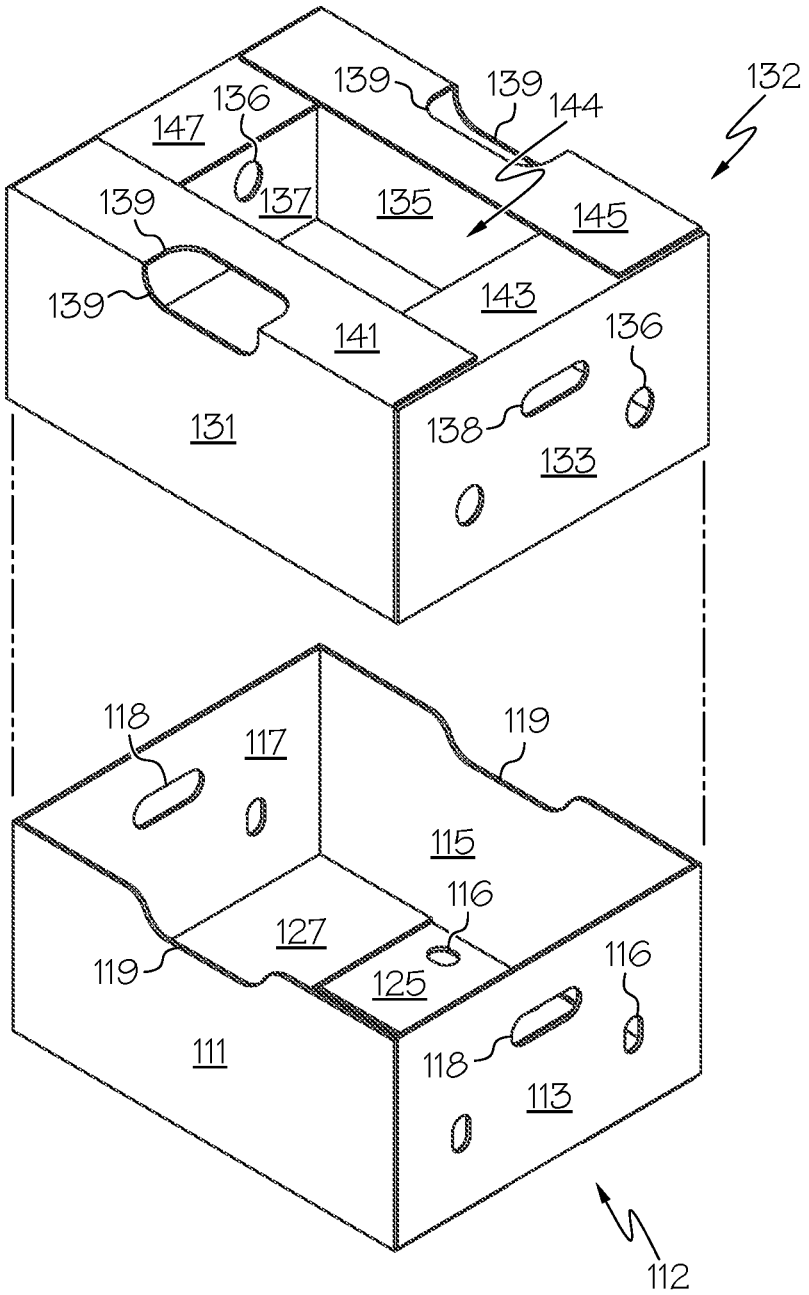
FIG. 20 is an exploded view of the produce box of FIG. 19.

To assemble base 112, as shown in FIG. 20, the panels 111, 113, 115, 117 are folded along the score lines 122 such that the side panels 111, 115 are substantially parallel with each other and the front and rear panels 113, 117 are substantially parallel with each other. Tab 129 may be folded inwardly and positioned against the interior surface of rear panel 117. In some versions, tab 129 is adhered to the rear panel 117 to maintain the base 112 in an assembled configuration. Panels 111, 113, 115, 117 thereby form an opening 124 through the top surface of the base 112. The flaps 121, 123, 125, 127 are then folded inward and secured (e.g., glued) to one another in order to form a bottom surface of the base 112. As can be seen in FIG. 20, when exemplary base 112 is assembled, flaps 121, 123, 125, 127 define an opening 126 in the bottom surface of the base 112, which aids in ventilation of the box 110 taken alone or stacked on a pallet with other boxes. Base 112 may be folded and glued at a packing station in a Manufacturing Join at Box Plant.

At least one ventilation aperture 116 is located in the flaps 121, 123, 125, 127 and/or on the panels 111, 113, 115, 117 of the base 112, and/or at least one ventilation cutout 119 is located on the panels 111, 113, 115, 117. For instance, as shown in FIGS. 20 and 21, each of the side panels 111, 115 comprise a ventilation cutout 119 extending inwardly from a top edge of the side panels 111, 115. Cutouts 119 have a generally rectangular shape with or without rounded corners. Other suitable shapes can be selected from square, triangular or trapezoidal. Such cutouts may extend along from about 30% to about 55% or from about 35% to about 50% of the length of each panel 111, 115. Some exemplary cutouts may extend along about 35% or about 50% of the length of each panel 111, 115. These cutouts 119 may allow air to flow through the cutouts 119 and laterally across a top portion of the box 110 to ventilate the box 110 when a plurality of boxes 110 are assembled and stacked on top of each other. While the cutouts 119 are shown on each of the side panels 111, 115, cutouts 119 may be positioned on any one or more of the panels 111, 113, 115, 117 of produce box 110. In the illustrated example, base 112 further comprises one or more apertures 116 on the front panel 113, rear panel 117, and flaps 121, 125. This may provide for further ventilation of box 110. Handholds (i.e., "handles") 118 may also be provided for additional ventilation, and/or for ease of transporting the box 110. Still other suitable ventilation configurations will be apparent to one with ordinary skill in the art in view of the teachings herein.

Some exemplary bases 112 may be reinforced so that they may be stacked in bottom layer(s) of a pallet without being crushed by the weight of further boxes 110 that are subsequently stacked thereon. A reinforced base 112 may comprise paper having a relatively higher grammage than paper that is used to form the bases 112 of boxes 110 stacked in higher layer(s) of boxes 110 on a pallet.

Figure 22:
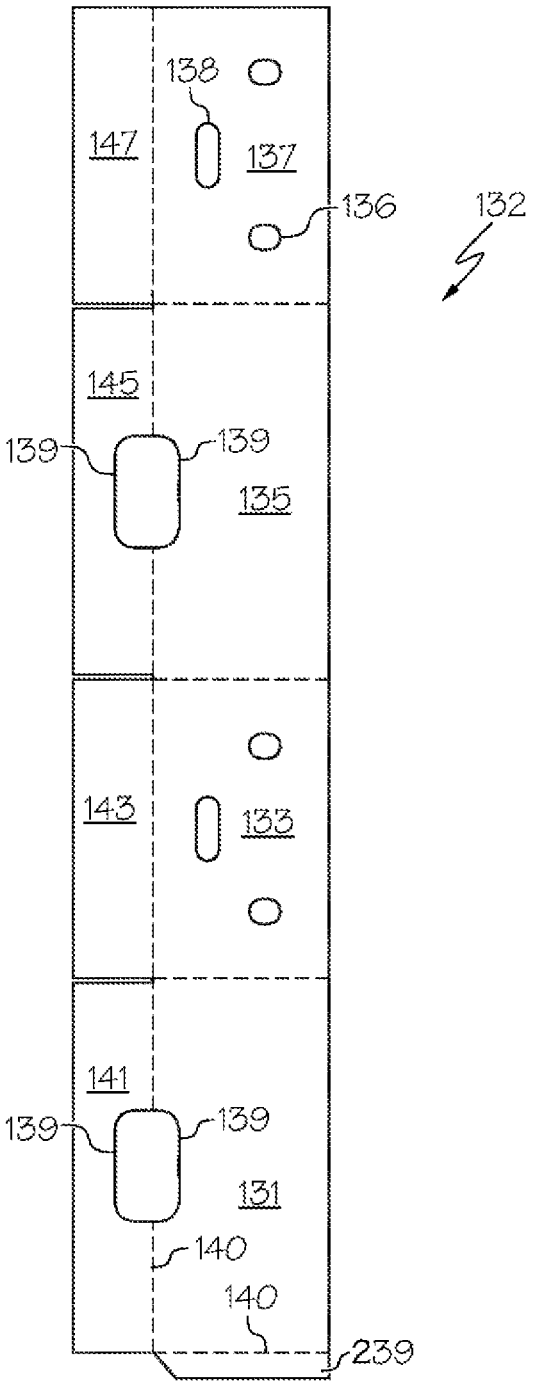
FIG. 22 is a top plan view of an unassembled lid of the produce box of FIG. 19.

FIG. 22 shows the lid 132 of the produce box 110 in an unassembled state. In the unassembled state, the lid 132 comprises a first side panel 131, a front panel 133, a second side panel 135 and a rear panel 137 aligned longitudinally with each other. Each panel 131, 133, 135, 137 comprises a respective flap 141, 143, 145, 147 extending outwardly from each panel 131, 133, 135, 137. In the illustrated example, the flaps 141, 143, 145, 147 each extend from the top edge of each panel 131, 133, 135, 137 such that each flap 141, 143, 145, 147 is longitudinally aligned with each other. A tab 139 is further positioned adjacent to the first side panel 131. In the illustrated example, a scored line 140 is provided between each panel 131, 133, 135, 137, flap 141, 143, 145, 147, and tab 139 to allow for easier assembly of lid 132.

To assemble lid 132, as shown in FIG. 20, the panels 131, 133, 135, 137 are folded along the score lines 140 such that the side panels 131, 135 are substantially parallel with each other and the front and rear panels 133, 137 are substantially parallel with each other. Tab 139 may be folded inwardly and positioned against the interior surface of rear panel 137. In some versions, tab 139 is adhered to the rear panel 137 to maintain the lid 312 in an assembled configuration. Panels 131, 133, 135, 137 thereby form an opening through the bottom surface of the lid 132. The flaps 141, 143, 145, 147 are then folded inward and secured (e.g., glued) to one another in order to form a top surface of the lid 132. As can be seen in FIG. 20, when exemplary lid 132 is assembled, flaps 141, 143, 145, 147 define an opening 144 in the top surface of the lid 132, which aids in ventilation of the box 110 taken alone or stacked on a pallet with other boxes. Lid 132 may be folded and glued at a packing station in a Manufacturing Join at Box Plant.

At least one ventilation aperture 136 is located in the panels 131, 133, 135, 137 of the lid 132, and/or at least one ventilation cutout 139 is located on the panels 131, 133, 135, 137. For instance, as shown in FIGS. 20 and 22, each of the side panels 131, 135 comprise a ventilation cutout 139 extending inwardly from a top edge of the side panels 131, 135. Cutouts 139 have a generally rectangular shape with or without rounded corners. Other suitable shapes can be selected from square, triangular or trapezoidal. Such cutouts may extend along from about 30% to about 55% or from about 35% to about 50% of the length of each panel 131, 135. Some exemplary cutouts may extend along about 35% or about 50% of the length of each panel 131, 135. These cutouts 139 may allow air to flow through the cutouts 139 and laterally across a top portion of the box 110 to ventilate the box 110 when a plurality of boxes 110 are assembled and stacked on top of each other. Cutouts 139 are also provided on the edge of each flap 141, 145 adjacent to the panels 131, 135 to align with the cutouts 139 on the panels 131, 135. This may allow for increased ventilation at the top portion of the box 110. While the cutouts 139 are shown on each of the side panels 131, 135, and flaps 141, 145, cutouts 139 may be positioned on any one or more of the panels 131, 133, 135, 137 and/or flaps 141, 143, 145, 147 of produce box 110.

In the illustrated example, lid 132 further comprises one or more apertures 136 on the front panel 133 and rear panel 137. This may provide for further ventilation of box 110. Handholds (i.e., "handles") 138 may also be provided for additional ventilation, and/or for ease of transporting the box 110. Still other suitable ventilation configurations will be apparent to one with ordinary skill in the art in view of the teachings herein.

Figure 19:
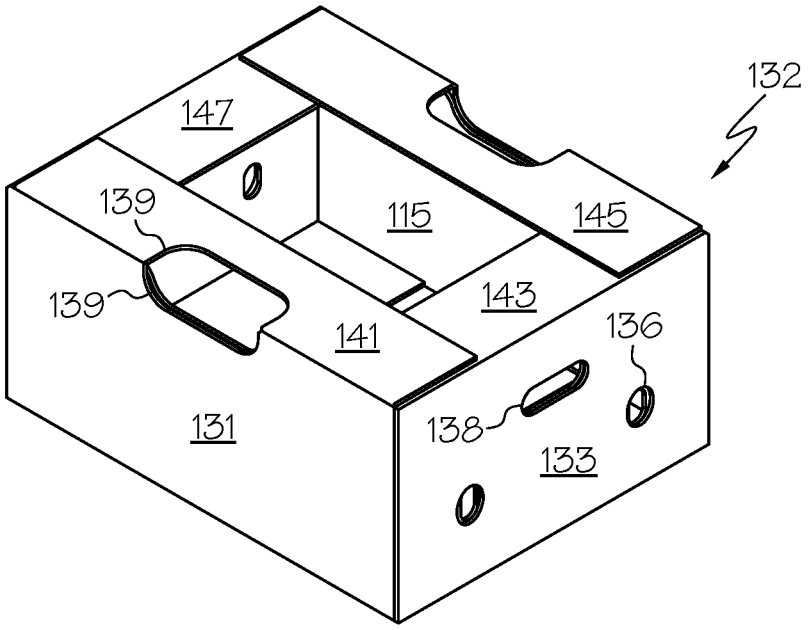
FIG. 19 is a top perspective view of a second exemplary produce box per the present disclosure.

In some examples, lid 132 and base 112 are of approximately equal score to score depth as shown in FIG. 19. To assemble box 110, lid 132 telescopically slides over base 112. Accordingly, the first side panel 131 of the lid 132 is positioned over the first side panel 111 of the base 112, the front panel 133 of the lid 132 is positioned over the front panel 113 of the base 112, the second side panel 135 of the lid 132 is positioned over the second side panel 115 of the base 112, and the rear panel 137 of the lid 132 is positioned over the rear panel 117 of the base 112. This aligns the top opening 144 of the lid 132 with the top opening 124 of the base 112 and the bottom opening 142 of the lid 132 with the bottom opening 126 of the base 112. Ventilation cutouts 119, 139, apertures 116, 136, and handholds 118, 138 of the base 112 and lid 132 are thereby aligned with each other to provide ventilation through the box 110.

Examples

A first exemplary box for storing produce comprising:

a bottom surface;

a pair of opposing side panels;

a pair of opposing end panels positioned between the pair of opposing side panels such that each end panel is adjacent to each side panel; and a top surface comprising corners extending between an end portion of each side panel and an end portion of each adjacent end panel, wherein the corners define an opening extending between the corners along the top surface, wherein the corners provide a surface area for receiving the bottom surface of another box in a stacked configuration.

A second exemplary box according to the first exemplary box, further comprising one or more apertures in at least one of the end panels.

A third exemplary box according to either one of the first or second exemplary boxes, further comprising a flexible bag disposed inside the box, wherein the flexible bag comprises a neck which can be opened.

A fourth exemplary box according to the third exemplary box, wherein the flexible bag comprises a perforation line disposed along the neck of the bag.

A fifth exemplary box according to either one of the third and fourth exemplary boxes, further comprising a ripcord that is configured to secure the neck in a closed position.

A sixth exemplary box according to the fifth exemplary box, wherein the ripcord is configured to open the bag along the perforation line when the ripcord is pulled.

A seventh exemplary box according to either one of the fifth or sixth exemplary boxes, wherein an end of the ripcord is disposed through an aperture of the box.

An eighth exemplary box according to the seventh exemplary box wherein the aperture is a handhold.

A ninth exemplary box according to any one of the first through eighth exemplary boxes, wherein the produce is bananas.

A first exemplary method for storing and shipping produce utilizing a box, a flexible bag, and a ripcord, wherein the box comprises a base portion a top portion, such that when the box is in a closed configuration, the top portion is disposed telescopically over the base portion such that one or more ventilation structures in the base portion and the top portion are aligned, wherein the flexible bag comprises a neck through which produce may be inserted, wherein the neck comprises a perforation line, and the ripcord is configured to releasably secure the neck in a closed position, the method comprising:

(a) placing the flexible bag in the base portion;
(b) placing produce into the flexible bag through the neck;
(c) securing the neck of the flexible bag in a closed position with the ripcord;
(d) placing the top portion of the box over the base portion of the box so that the box is in the closed configuration; and
(e) passing an end of the ripcord through at least one of the ventilation structures in the box in the closed configuration.

A second exemplary method according to the first exemplary method, further comprising opening the bag by pulling the ripcord and tearing the bag along the perforation line.

A third exemplary method according to the second exemplary method, further comprising opening the bag without removing the top portion from the base portion of the box.

A fifth exemplary method according any one of the first through third exemplary methods, wherein the ventilation structure is a handhold.

A sixth exemplary method according to any one of the first through fifth exemplary methods, wherein the produce is bananas.

An exemplary system for packing, storing, shipping and/or displaying produce comprising:

(a) a box comprising:
(1) a bottom surface;
(2) a pair of opposing side panels;
(3) a pair of opposing end panels positioned between the pair of opposing side panels such that each end panel is adjacent to each side panel; and
(4) a top surface comprising corners extending between an end portion of each side panel and an end portion of each adjacent end panel, wherein the corners define an opening extending between the corners along the top surface, wherein the corners provide a surface area for receiving the bottom surface of another box in a stacked configuration;
(b) a flexible bag comprising:
(1) a neck which can be opened; and
(2) a perforation line disposed on the neck;
wherein the bag is configured to be opened by applying force to the perforation line; and (c) a ripcord that is configured to:
(1) secure the bag in a closed position at the neck; and
(2) open the bag along the perforation line when the ripcord is pulled.

What is claimed is:

1. A box for storing produce comprising:

(a) a base comprising:
(i) a front base panel,
(ii) a rear base panel, and
(iii) a pair of opposing base side panels, wherein the pair of opposing base side panels are longer relative to the front base panel and rear base panel,
(iv) a single continuous base cutout extending inwardly from a top edge of each opposing base side panel, wherein the single continuous base cutout extends along an area that is about 30% to about 55% of a length of the top edge of each opposing base side panel, wherein the area that is about 30% to about 55% of the length of the top edge extends in a direction that extends from the front base panel toward the rear base panel, wherein each opposing base side panel includes a continuous remaining top edge; and
(b) a lid comprising:
(i) a front lid panel,
(ii) a rear lid panel, and
(iii) a pair of opposing lid side panels, wherein the pair of opposing lid side panels are longer relative to the front lid panel and rear lid panel,
(ii) a lid cutout extending inwardly from a top edge of each opposing lid side panels adjacent to a lid opening, wherein the lid is positionable about the base such that the lid cutout is similarly shaped as the single continuous base cutout and is aligned with the single continuous base cutout.

2. The box of claim 1, wherein the base further comprises a plurality of bottom flaps that extend from a bottom edge of the front base panel, rear base panel, and opposing base side panels, wherein the plurality of bottom flaps form a bottom surface of the box.

3. The box of claim 2, wherein the plurality of bottom flaps collectively define a bottom opening that extends through the bottom surface of the box.

4. The box of claim 2, wherein each opposing base side panels includes a bottom flap, wherein each of the bottom flaps defines a base aperture.

5. The box of claim 2, wherein each opposing base side panels includes a bottom flap, wherein each of the bottom flaps defines a pair of base apertures.

6. The box of claim 1, wherein the base further comprises at least one handhold through a select one or more of the front base panel, rear base panel, and opposing base side panels.

7. The box of claim 5, wherein the lid further comprises a plurality of top flaps extending from a top edge of the front lid panel, rear lid panel, and opposing lid side panels, wherein the plurality of top flaps forms a top surface of the box and a top opening.

8. The box of claim 7, wherein the lid comprises a top cutout extending inwardly from an edge of the top flaps of each opposing lid side panels.

9. The box of claim 8, wherein the top cutout adjoins the lid cutout.

10. The box of claim 9, wherein the top cutout includes a larger area relative to the lid cutout.

11. The box of claim 8, wherein the top cutout is vertically aligned with the pair of base apertures.

12. The box of claim 11, wherein the pair of base apertures include a first area, and the top cutout has a second area, wherein the first area is less than the second area.

13. The box of claim 1, comprising a flexible bag disposed inside the box, wherein the flexible bag comprises a neck at a top portion of the flexible bag, wherein the flexible bag comprises a top opening above the neck.

14. The box of claim 13, wherein the flexible bag comprises a perforation line disposed below the neck of the flexible bag.

15. The box of claim 1, wherein one of the front base panel or the rear base panel includes an end aperture.

16. A box for storing produce comprising:

(a) a base comprising:
- (i) a front base panel,
- (ii) a rear base panel,
- (iii) a first side base panel, and
- (iv) a second side base panel, wherein the first side base panel and the second side base panel are a longer relative to the front base panel and rear base panel, wherein the first side base panel defines a top edge defining a single first side base cutout and a continuous remaining top edge, wherein the single first side base cutout extends away from a top of the first side base panel, wherein the single first side base cutout includes 30% to about 55% of a length of the first side base panel, wherein the second side base panel defines a single second side base cutout extending away from the top of the second side base panel, wherein the single second side base cutout extends away from the top of the first side base panel, wherein the single second side base cutout includes 30% to about 55% of a length of the second side base panel, wherein the front base panel, rear base panel, first side base panel, and second side base panel define a base opening; and (b) a lid comprising:
- (i) a front lid panel,
- (ii) a rear lid panel, and
- (v) a pair of opposing lid side panels, wherein the pair of opposing lid side panels are longer relative to the front lid panels and rear lid panels, wherein each opposing lid side panel defines a lid cutout extending away from a top edge of each opposing lid side panel and a remaining portion of each opposing lid side panel having a flat surface, wherein the lid is positionable about the base such that the lid cutout is aligned with the respective first side base cutout or second side base cutout, wherein the front lid panel, rear lid panel, and opposing side lid panels define a lid opening.

17. The box of claim 16, wherein the base further comprises a bottom flap extending from a bottom edge each of the front base panel, rear base panel, and opposing base side panels, wherein the bottom flaps form a bottom surface of the box, wherein the bottom flaps of each opposing base side panel include at least one bottom aperture.

18. The box of claim 17, wherein the lid further comprises a top flap extending from a top edge of each of the front lid panel, rear lid panel, and opposing lid side panels, wherein the top flaps of the front lid panel, rear lid panel, and opposing lid side panels collectively define a top surface of the box, wherein top flaps of each opposing lid side panel includes a top aperture extending into the top flap of each opposing lid side panel from an edge and the top apertures is aligned with base cutout and lid cutout, wherein the at least one bottom aperture is vertically aligned with the top aperture.

19. The box of claim 18, wherein the base opening is smaller than the lid opening, and at least one bottom aperture includes a pair of bottom apertures, wherein the bottom apertures are aligned with the top aperture.

20. A box for storing produce comprising:

(a) a base consisting of:
- (v) a front base panel,
- (vi) a rear base panel, and
- (vii) a pair of opposing base side panels, wherein the pair of opposing base side panels are longer relative to the front base panel and rear base panel, wherein the front base panel, rear base panel, and opposing base side panel define a base opening,
- (viii) a single base cutout extending inwardly from a top edge of each opposing side panel wherein the single base cutout is centrally located along the top edge of each opposing side panel and extends along an area that is about 30% to about 55% of a length of the top edge of each opposing side panel, wherein the area that is about 30% to about 55% of the length of the top edge extends in a direction that extends from the front base panel toward the rear base panel, wherein the top edge of each opposing side panel includes a continuous remaining top edge; and (c) a lid consisting of:
- (k) a front lid panel,
- (ii) a rear lid panel, and
- (iii) a pair of opposing lid side panels, wherein the pair of opposing lid side panels are longer relative to the front lid panels and rear lid panels, wherein the front lid panels, rear lid panels, and opposing lid side panels define a lid opening,
- (iv) a lid cutout extending inwardly from a top edge of each opposing lid side panel adjacent to the lid opening, wherein the lid is positionable about the base such that the lid cutout is aligned with the single base cutout.

* * * * *